US011261585B2

(12) United States Patent
Zenier et al.

(10) Patent No.: US 11,261,585 B2
(45) Date of Patent: Mar. 1, 2022

(54) LOCK FOR SECURING A WEAR MEMBER FOR EARTH WORKING EQUIPMENT

(71) Applicant: ESCO GROUP LLC, Portland, OR (US)

(72) Inventors: Scott H. Zenier, Portland, OR (US); Michael B. Roska, Portland, OR (US); Joel S. Hankland, Canby, OR (US)

(73) Assignee: ESCO GROUP LLC, Portland, OR (US)

( * ) Notice: Subject to any disclaimer, the term of this patent is extended or adjusted under 35 U.S.C. 154(b) by 0 days.

(21) Appl. No.: 16/834,818

(22) Filed: Mar. 30, 2020

(65) Prior Publication Data

US 2020/0224393 A1 Jul. 16, 2020

Related U.S. Application Data

(62) Division of application No. 15/588,376, filed on May 5, 2017, now Pat. No. 10,612,214.

(60) Provisional application No. 62/332,286, filed on May 5, 2016.

(51) Int. Cl.
*E02F 9/28* (2006.01)
*E02F 3/40* (2006.01)

(52) U.S. Cl.
CPC ..... *E02F 9/2833* (2013.01); *E02F 9/2883* (2013.01); *E02F 3/40* (2013.01); *E02F 9/2808* (2013.01)

(58) Field of Classification Search
CPC ..... E02F 3/40; E02F 9/2808; E02F 9/2833; E02F 9/2883
USPC ..... 37/456
See application file for complete search history.

(56) References Cited

U.S. PATENT DOCUMENTS

| | | | | |
|---|---|---|---|---|
| 7,536,811 | B2 * | 5/2009 | McClanahan | E02F 9/2833 37/455 |
| 8,074,383 | B2 * | 12/2011 | McClanahan | E02F 9/2833 37/455 |
| 8,978,277 | B2 * | 3/2015 | Knight | E02F 9/2833 37/456 |
| 10,487,479 | B2 * | 11/2019 | Marchand | E02F 9/2883 |
| 10,612,214 | B2 * | 4/2020 | Zenier | E02F 9/2883 |

FOREIGN PATENT DOCUMENTS

| | | |
|---|---|---|
| EP | 1852557 | 8/2008 |
| WO | 2002/012642 | 2/2002 |
| WO | 2008/021376 | 2/2008 |
| WO | 2015/089565 | 6/2015 |

* cited by examiner

*Primary Examiner* — Gary S Hartmann
(74) *Attorney, Agent, or Firm* — Steven Schad; Palmer Dzurella

(57) ABSTRACT

An articulated lock for securing a wear member to earth-working equipment includes a plurality of bodies interconnected for pivotal movement between an extended orientation with the bodies aligned and a retracted orientation with the bodies folded. The lock in the extended orientation can engage an opening of the wear member at an inner hold position to secure the wear member to the earth-working equipment or an outer release position. In the folded orientation the lock disengages from the opening of the wear member. Each body has a slot and a tab and, in the extended orientation, the tab of each body is received in the slot of the other body to limit separation of the bodies.

14 Claims, 19 Drawing Sheets

LOCK FOR SECURING A WEAR MEMBER FOR EARTH WORKING EQUIPMENT

RELATED APPLICATIONS

This application is a divisional of pending application Ser. No. 15/588,376, filed May 5, 2017, which claims priority benefits based upon U.S. Provisional Patent Application No. 62/332,286, filed May 5, 2016, both entitled "A Wear Part for Earth Working Equipment." These earlier priority applications are incorporated herein by reference each in their entirety.

FIELD OF THE INVENTION

The present invention pertains to wear members and locks for securing wear members to earth-working equipment.

BACKGROUND OF THE INVENTION

Wear parts are commonly attached to earth-working equipment such as excavating buckets and the like. For example, teeth and shrouds are generally mounted along the digging edge of an excavating bucket to protect the bucket from wear and to enhance the digging operation. Such wear assemblies typically include a base, a wear member, and a lock to releasably hold the wear member to the base. The base is fixed to the equipment as an integral part of the equipment, or as one or more components that are fixed to the equipment by welding or mechanical attachment. The wear member fits over the base. The assembled base and wear member cooperatively define a cavity into which the lock is received to releasably hold the wear member to the base.

Wear members for earth-working equipment are commonly subjected to harsh conditions and/or heavy loading. Accordingly, it is desirable for the locks to have the strength needed to effectively retain the wear member to the equipment, resist ejection during use, and be easy to install and remove in the field when replacement of the wear part is needed. Many different lock arrangements have been designed in an effort to meet these objectives with varying degrees of success.

SUMMARY OF THE INVENTION

The present invention pertains to wear parts for earth-working equipment, and in particular to a locking arrangement that is strong, durable, resistant to ejection, easy to manufacture at reduced costs, convenient to inventory and ship, and/or simple and safe to use.

In one embodiment, a wear member is configured to receive and hold a hinged lock at two different positions including a release position and a hold position.

In another embodiment, a wear member is provided with a lock retained to the wear member in both hold and release positions without the use of a resilient element such as an elastomer.

In another embodiment, a wear member for earth working equipment has an exterior surface subject to wearing by engagement with the ground, a rear mounting portion including an interior surface, and a hole opening to the interior surface and the exterior surface. The hole includes opposing surfaces each of which have a pair of retainers for securing a lock to the wear member in two distinct positions such that the lock can be secured in a first position that permits installation of the wear member on the earth working equipment and a second position where the lock can secure the wear member to the earth working equipment. In one preferred construction, the orientation of the lock in the release position is generally parallel to the orientation of the lock in the hold position.

In another embodiment, a wear member for earth working equipment includes a hole with a retention feature to engage and retain a hinged lock in a release position where the wear member can be installed on the earth working equipment and in a hold position where the wear member can be secured to earth working equipment.

In another embodiment, a wear assembly for earth working equipment includes a wear member with an opening that has opposing walls each with a retainer assembly, and a lock to engage the opposing walls to retain the lock in the opening in a release position that permits the wear member to be installed on the earth working equipment and in a hold position that can secure the wear member to the earth working equipment. The lock is adjustable between a locked condition where the lock engages the opposing walls and an unlocked condition where the lock disengages the opposing walls for repositioning from the release position to the hold position.

In another embodiment, an articulated lock for securing a wear member to earth-working equipment includes a plurality of bodies interconnected for pivotal movement between an extended orientation with the bodies aligned and a retracted orientation with the bodies folded. The lock in the extended orientation can engage the wear member at a retaining position to secure the wear member to the earth-working equipment, and in the folded orientation can disengage the wear member. Each body has a slot and a tab and, in the extended orientation, the tab of each body is received in the slot of the other body to limit separation of the bodies.

In another embodiment, a lock for securing a wear member to earth working equipment includes hinged members pivotally coupled together for movement between an extended position and a retracted position, and an insert. The hinged members are interlocked by at least one tongue and groove configuration to limit separation of the members along a pivot axis of the hinged members, and pivoting movement of the hinged members is prevented by installation of the insert between the members when in a locked position to secure the wear member to the earth working equipment.

In another embodiment, a lock for securing a wear member to earth working equipment includes hinged members each with an inner face, the hinged members being pivotally coupled together for movement along the inner faces between an extended position and a retracted position, and an insert. A first hinged member includes a recess in the inner face and a first bearing face adjacent the recess. A second hinged member includes a collar with a hole and a second bearing face adjacent the collar. The collar is received in the recess, and the insert is installed in the hole and engages the bearing surfaces to limit pivotal movement of the hinged members and secure the wear member to the earth working equipment.

In another embodiment, a lock for securing a wear member to earth working equipment comprises hinged members each with an inner face, a recess in the inner face and a bearing surface adjacent the recess, a collar and an insert. The hinged members are pivotally coupled together for movement along the inner faces between an extended position and a retracted position. The collar includes a hole and is received in the recesses. The insert is installed in the hole and engages the bearing surfaces to limit pivotal movement of the hinged members and secure the wear member to the earth working equipment.

In another embodiment, a method of securing a wear member to earth working equipment includes installing the wear member on the earthmoving equipment with a lock secured in a release position in an opening of the wear member, disengaging the lock from walls defining the opening in the release position, and engaging the lock with the walls defining the opening in a hold position different than the release position to hold the wear member on the earth working equipment.

In another embodiment, the lock includes end walls that are shaped to cooperate with sides of the opening in the wear part to thereby resist ejection of the lock during use. Each of the end walls can be engaged in the two distinct location to secure the wear member in a release position and a hold position.

In another embodiment, interlocks are provided on each of the two lock components. When the lock components are in the extended position, the interlocks can resist transverse movement of the lock components relative to one another, and thereby improve the stability of the lock.

In another embodiment, each piece of a two-piece lock can be preloaded in a transverse direction by installing the insert between the two pieces of the lock that are interlocked to resist movement of the pieces relative to each other. The application of such forces tends to keep the insert in place and reduce the risk of losing the lock during use.

In another embodiment, generally frusta-conical bore portions are defined along a split line separating lock components, wherein a first portion of the frusta-conical bore is defined in one lock component and a second portion of the frusta-conical bore is defined in a second lock component. A frusta-conical insert is positionable in the frusta-conical bore to prevent movement (i.e., retraction) of the two components relative to each other. In one embodiment, one bore portion is smaller than the received insert to define in essence a three point or line engagement of the lock components with the insert.

In another embodiment, a frusta-conical insert having a radius at a selected depth of insertion into a longitudinally combined two channel frusta-conical bore is larger than that radius of curvature of a first channel and smaller that the radius of curvature of the second channel.

DETAILED DESCRIPTION OF THE PREFERRED EMBODIMENTS

Figure 1:
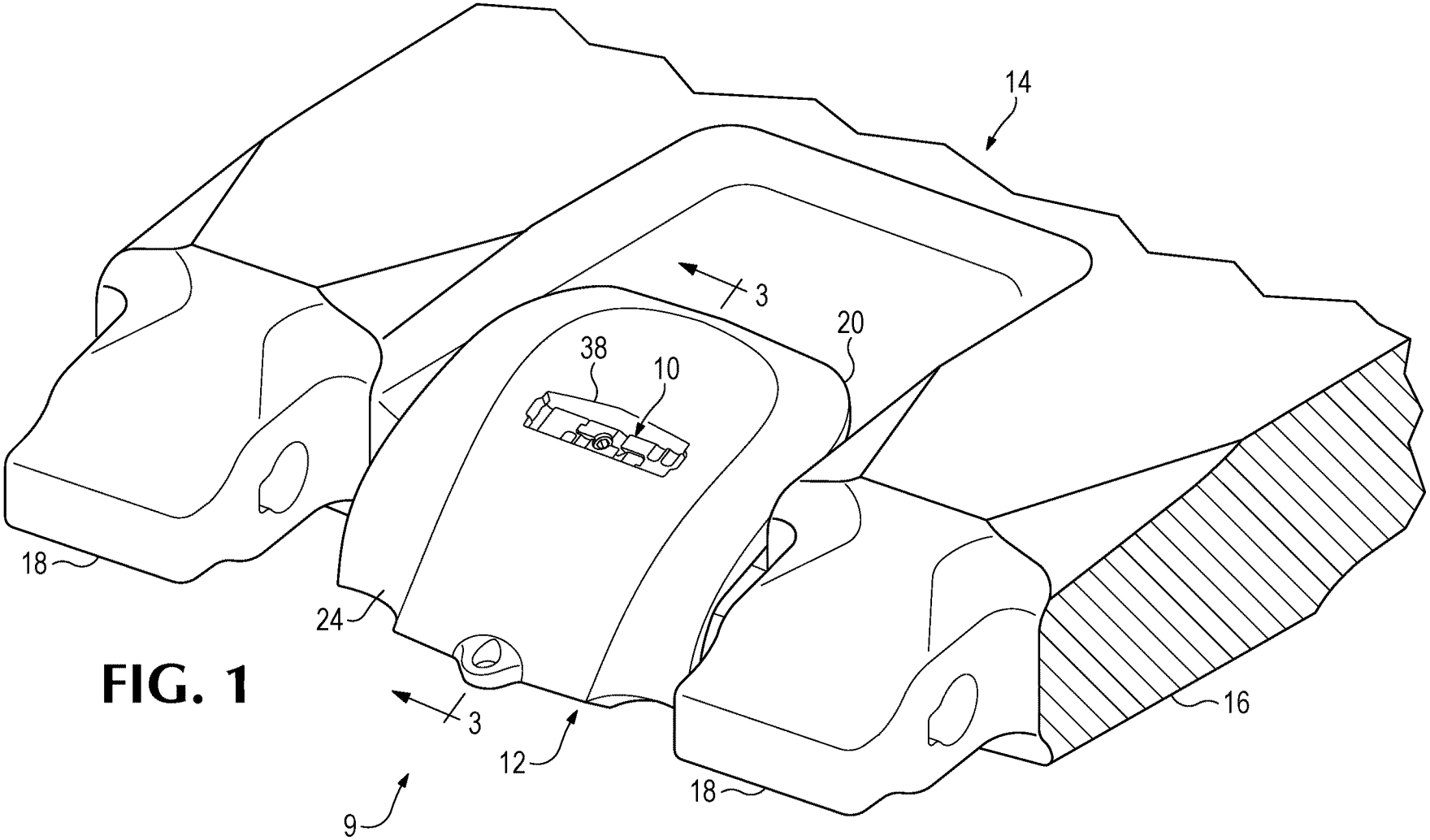
FIG. 1 is a perspective view of a wear assembly wherein the wear member is a shroud secured to a lip of an excavating bucket with a lock (the lip being only partially shown).

The present invention pertains to wear parts 9 for earth-working equipment 14. In one embodiment, wear part 9 includes a wear member 12 and a lock 10 for releasably securing the wear member 12 to earth-working equipment 14. In this example, wear member 12 is a shroud secured to a lip 16 of an excavating bucket by a lock 10 (FIGS. 1-22). Nevertheless, the wear members could have other forms (for example, other kinds of shrouds, excavating teeth, runners, liners, blades, etc.). Also the wear member could be secured to other kinds of earth-working equipment (e.g., mold boards, dredge cutter heads, ore chutes, truck bodies, etc.). In this description, relative terms such as forward, rearward, up or down are used for convenience of explanation with reference to the figure; other orientations are possible.

Figure 2:
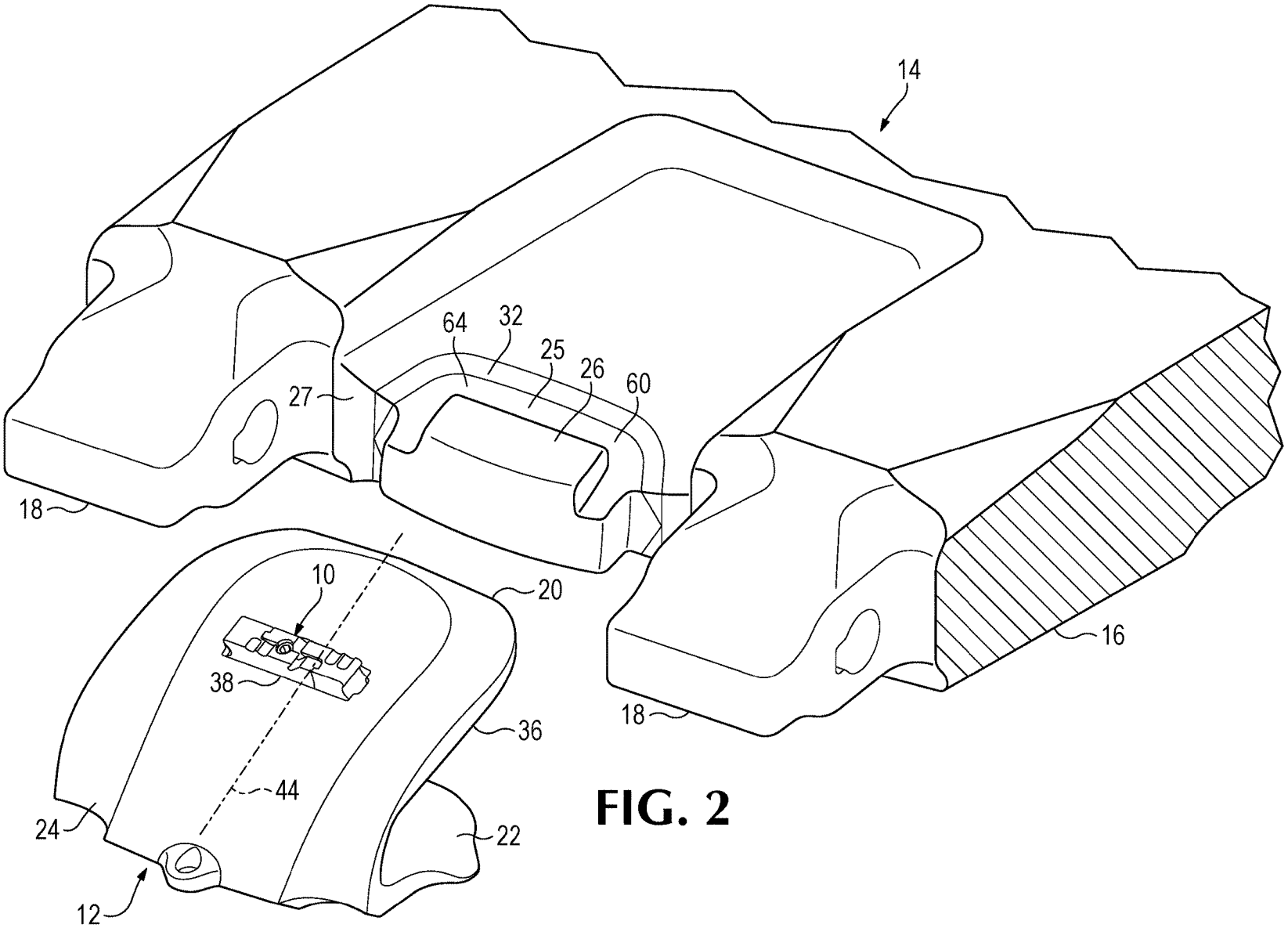
FIG. 2 is an exploded perspective view of the wear assembly of FIG. 1.
Figure 3:
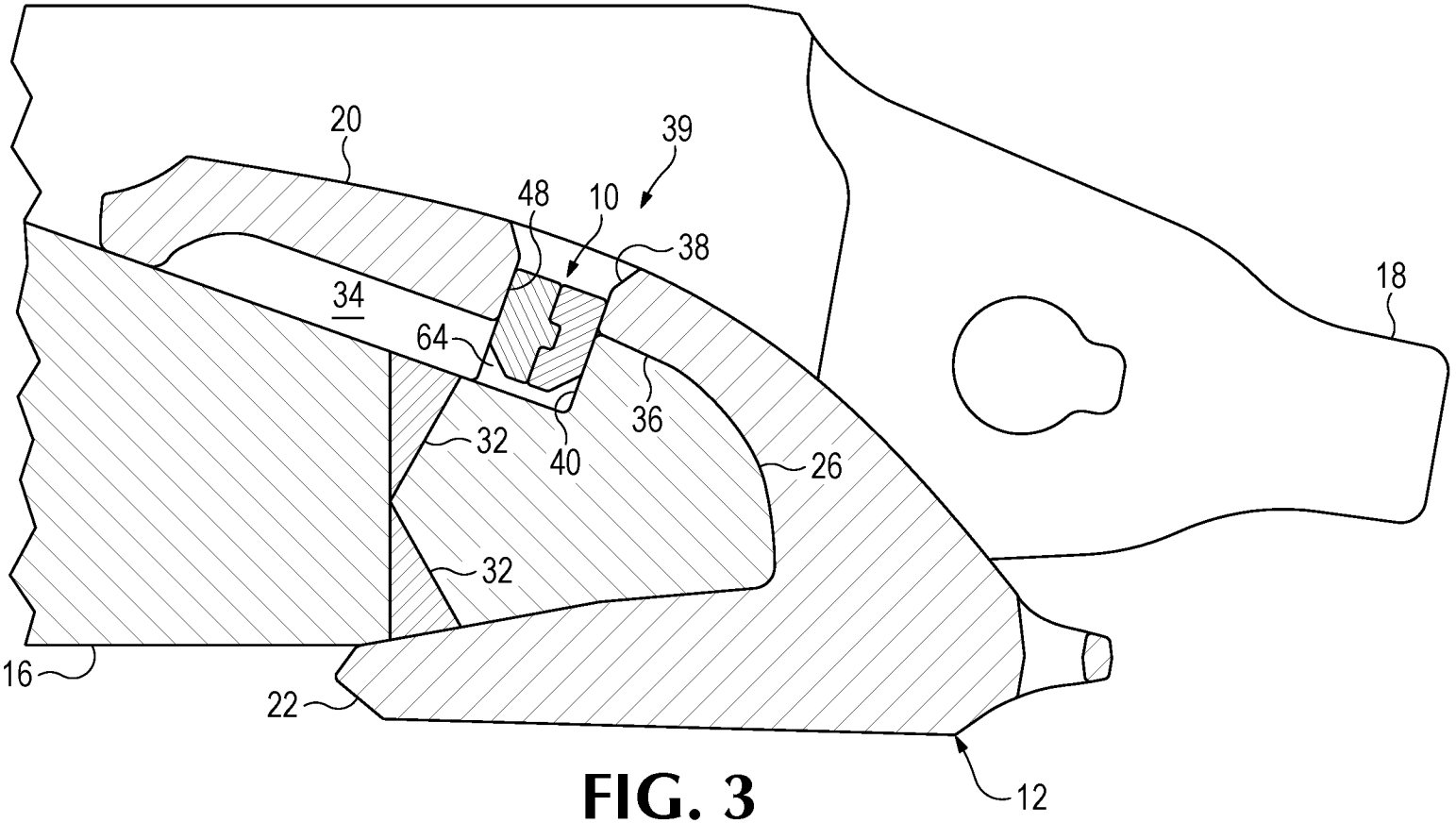
FIG. 3 is a cross-sectional view taken along line 3-3 in FIG. 1.

FIGS. 1-3 illustrate a shroud 12 fit onto a lip 16 between two noses 18 that support excavating points (not shown). In this one embodiment, lip 16 includes a base 25 that may be fixed into place via welding 32 (FIG. 3), though the base could be cast as part of the lip. The base 25 includes a boss 26 along the front edge 27 of the lip 16. Base 25 includes a rear bearing surface 40 on a rear side of boss 26, and a rearward surface 60 rearward of boss 26. The bearing surface 40 and rear surface 60 define a step or recess 64 for receiving the lock. Boss 26 further includes a forward facing front thrust surface 28 for abutting a corresponding front bearing surface 29 in the cavity 30 in the wear member. Boss 26 also includes side bearing surfaces 31 preferably extending axially from front thrust surface 28 to rear bearing surface 40. The base, of course, could have many different constructions to cooperate with various wear members.

Figure 4:
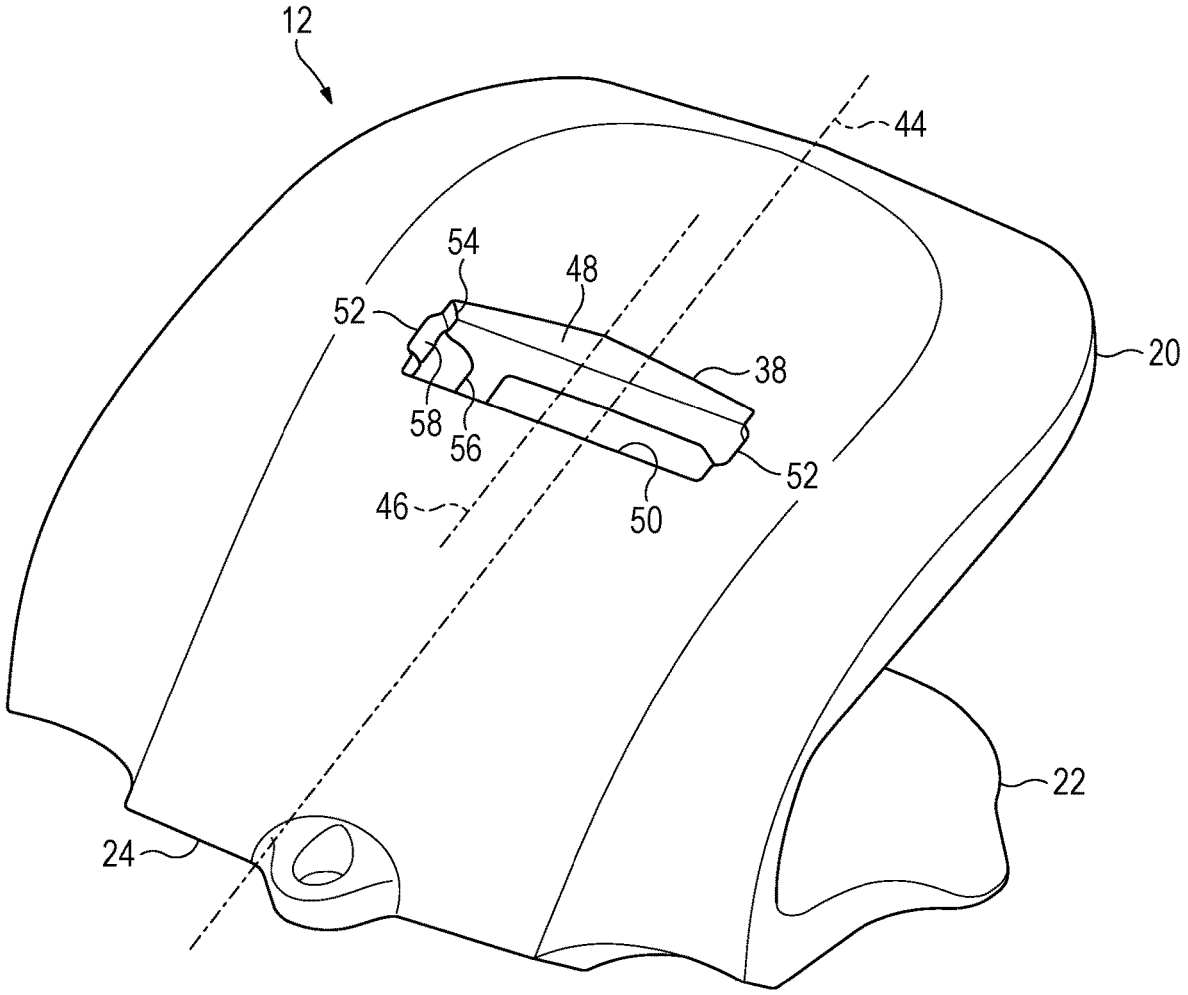
FIG. 4 is a top perspective view of the wear member.
Figure 5:
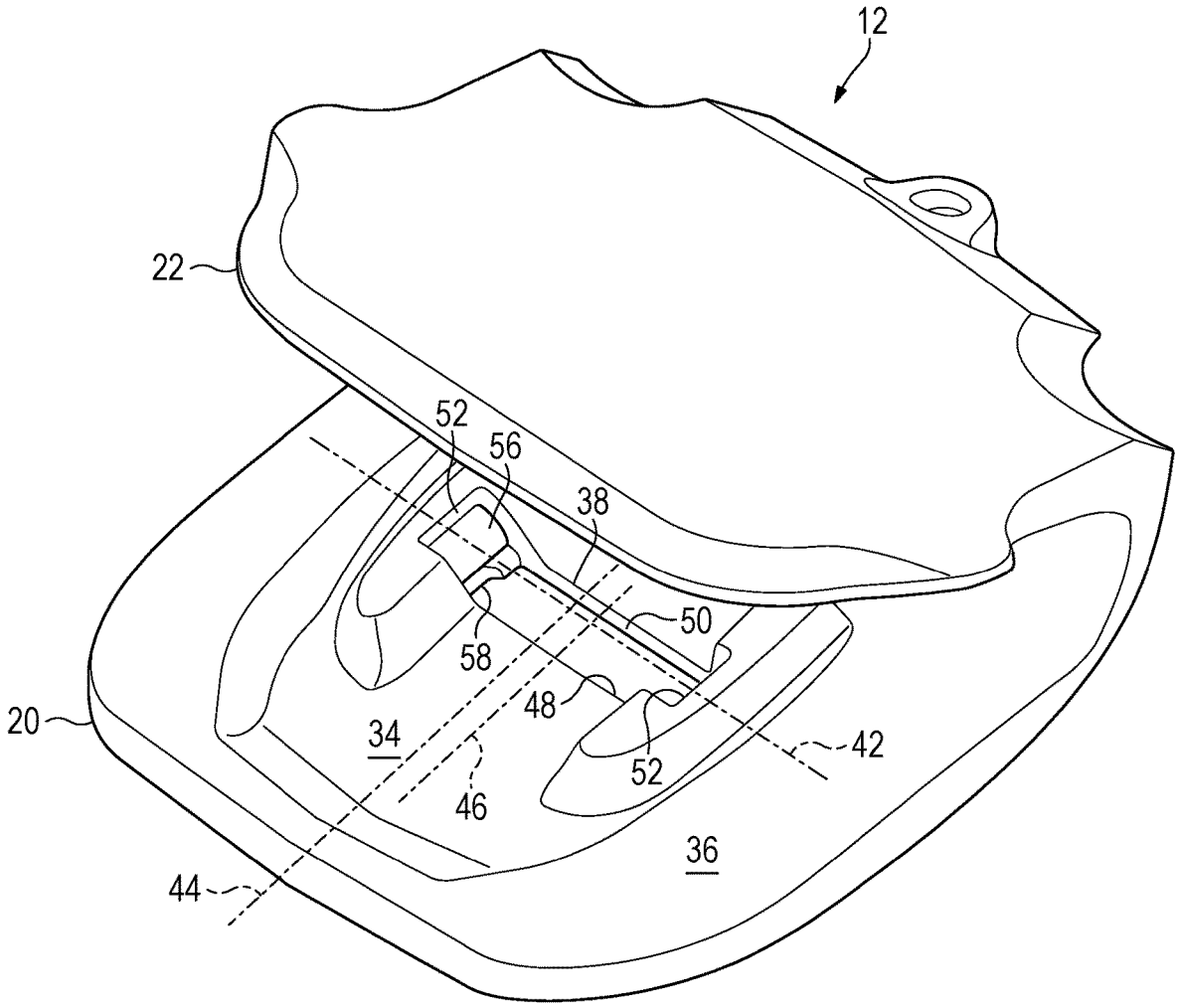
FIG. 5 is a bottom perspective view of the wear member.

In this example, wear member 12 includes a pair of legs 20, 22 to straddle lip 16, and a wearable exterior surface 24. An inner surface 36 of top leg 20 includes a recess 34 to provide clearance when passing the shroud 12 over the boss 26 and to receive the boss 26 within a forward position in the recess 34. Recess 34 is bordered by side walls 33 to oppose and bear against side bearing surfaces 31 and front bearing surface 29. The recess 34 may be a hole in leg 20 or as an offset surface around the boss at the forward portion (FIG. 4-5). A hole 38 is provided through the leg 20 to receive lock 10. In the example illustrated, the hole 38 has a longitudinal axis 42 arranged transverse to a central axis 44 of the shroud 12. The hole 38 includes a back wall 48, a front wall 50 and opposing end walls 52. Hole 38 and recess 64 collectively define an opening 39 into which lock 10 is received in the hold position.

The end walls 52 each includes retainers 54, 56 to interact with lock 10 and support the lock in release and hold positions. With the lock in the release position, wear member 12 can be installed on or removed from base 25 (i.e., the earth-working equipment). With lock 10 in the hold position, the wear member can be secured to the base 25. In the illustrated embodiment, retainers 54, 56 are protrusions that extend inward from end walls 52. Nevertheless, retainers 54, 56 could have other constructions such as, e.g., being formed as one or more recesses that receive complementary projections on the lock or e.g., could be formed on the front and rear walls 48, 50.

Moreover the retainers could be formed as a single retainer formation that permits mounting of the lock in both the release and hold positions. For example, the ends of the lock could have two different formations to receive a single retainer in the hole to secure the lock in two positions. Accordingly, even though this disclosure generally refers to two retainers 54, 56 on each end wall, the number of retainers is not important. There could be one or more than two retainers provide to secure the lock in the release position and the hold position.

Figure 11:
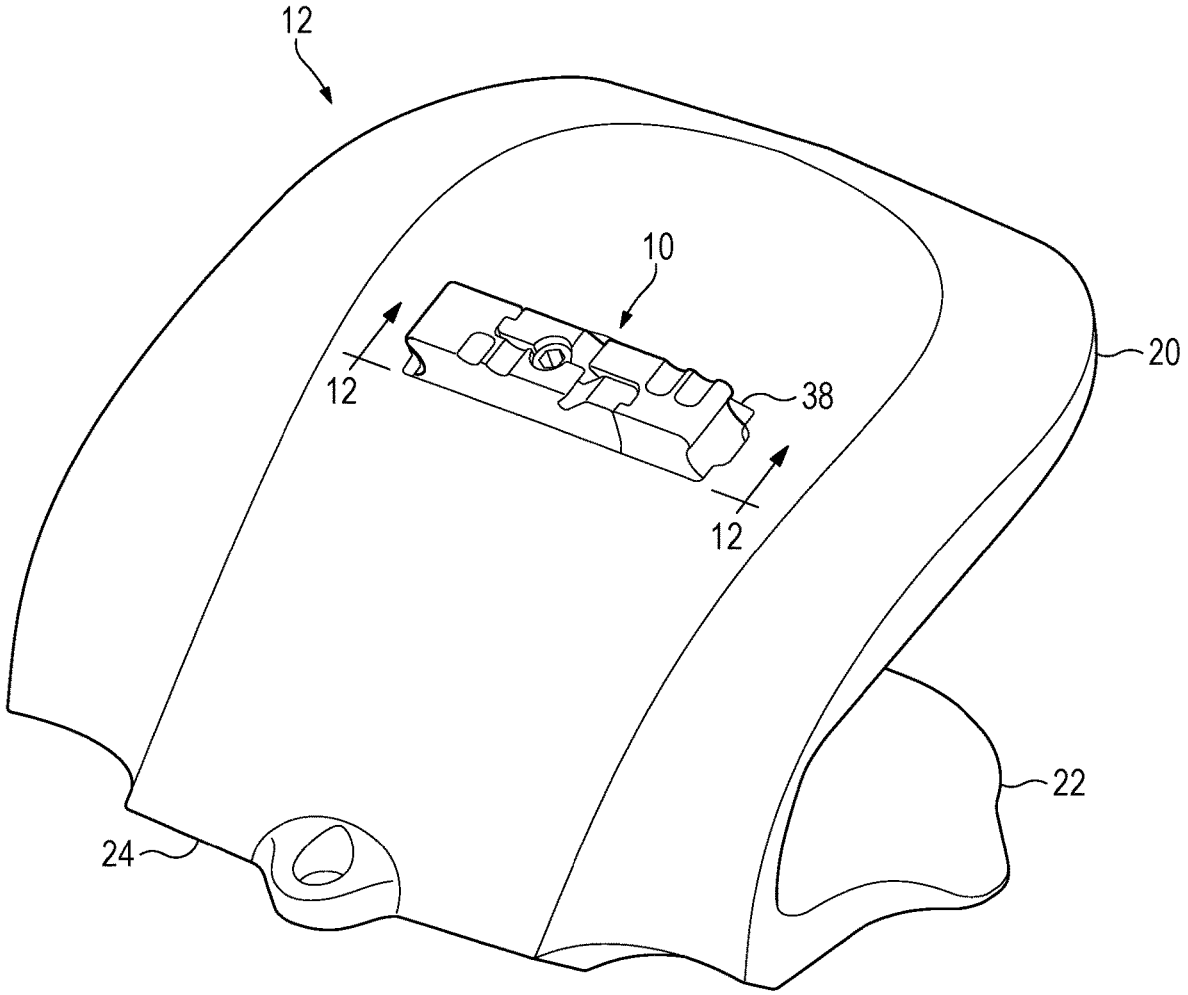
FIG. 11 is a perspective view of a shroud with the lock installed in the release positon.
Figure 12:
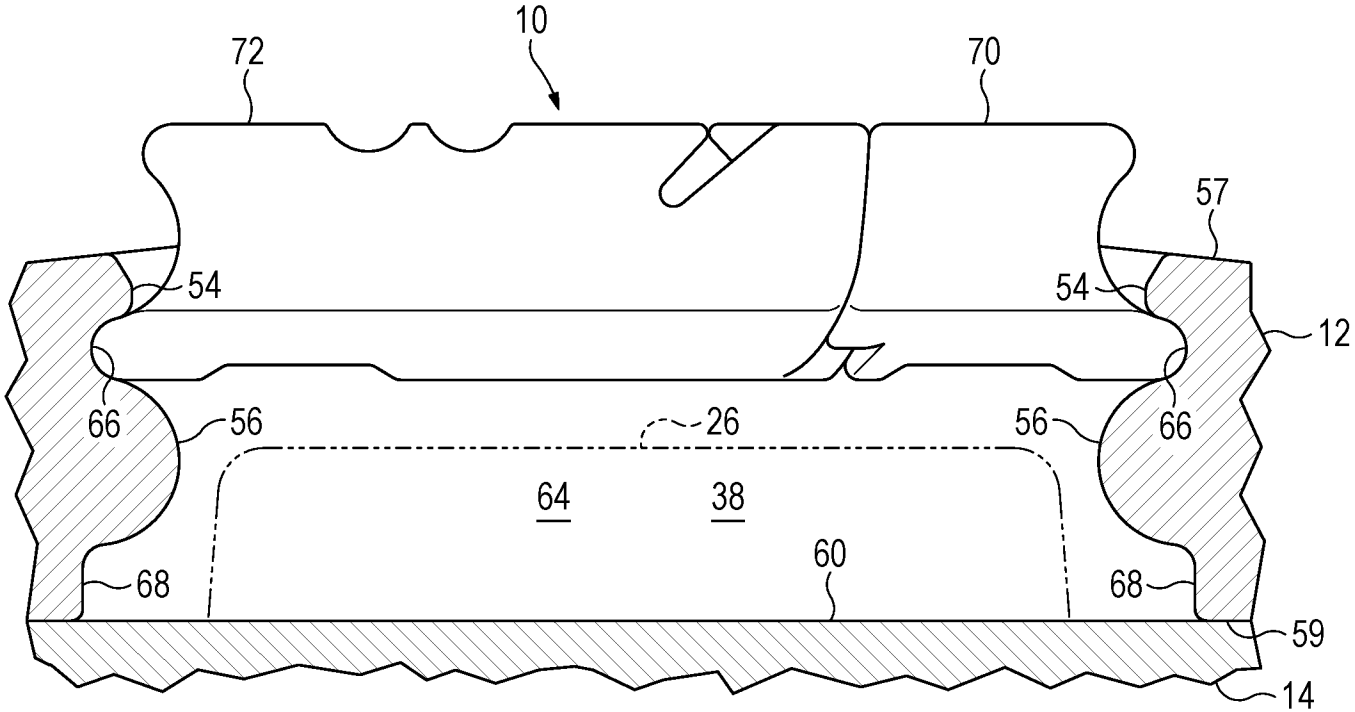
FIG. 12 is a cross-sectional view taken along line 12-12 in FIG. 11.
Figure 13:
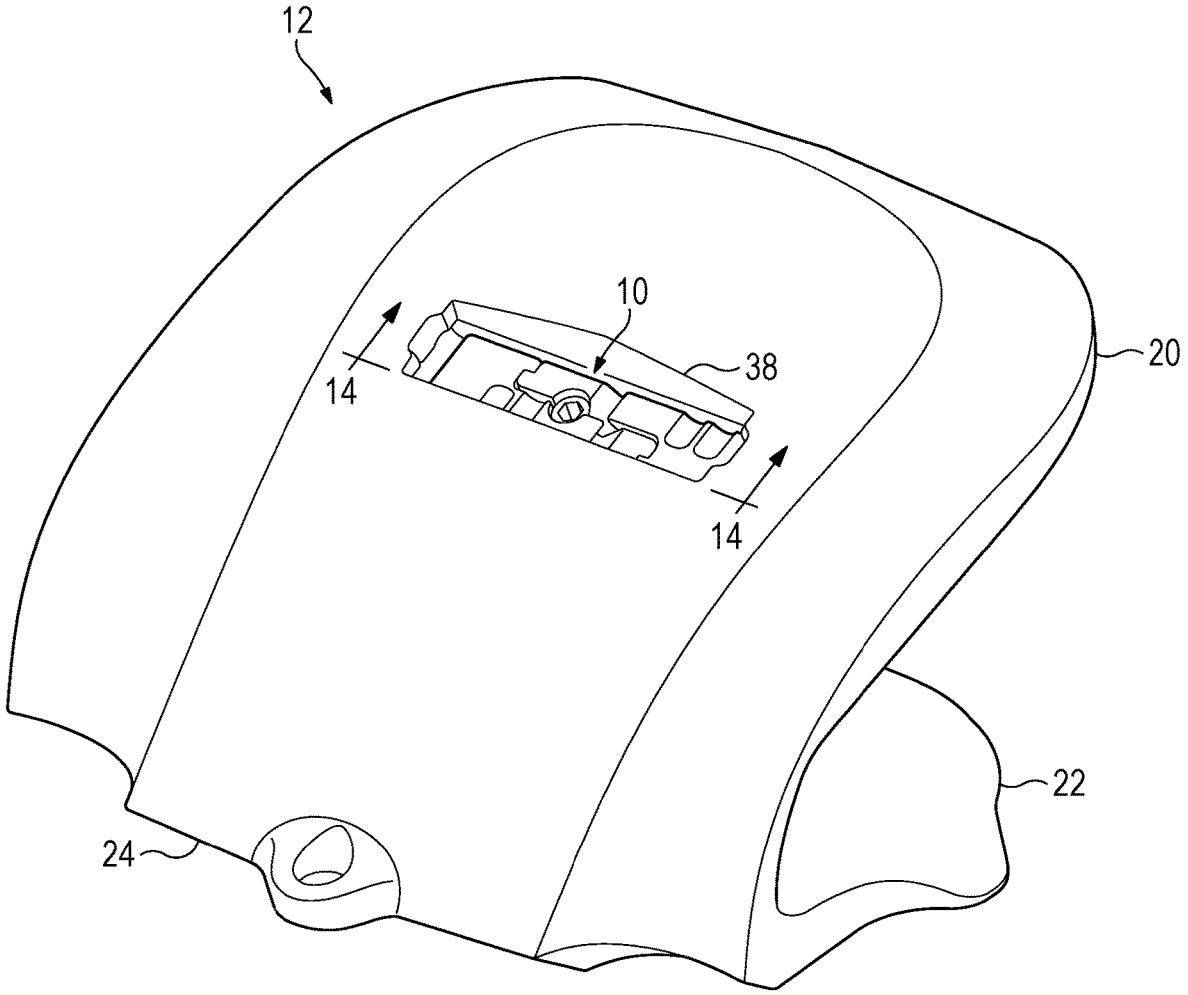
FIG. 13 is a perspective view of a shroud with the lock installed in the hold positon.
Figure 14A:
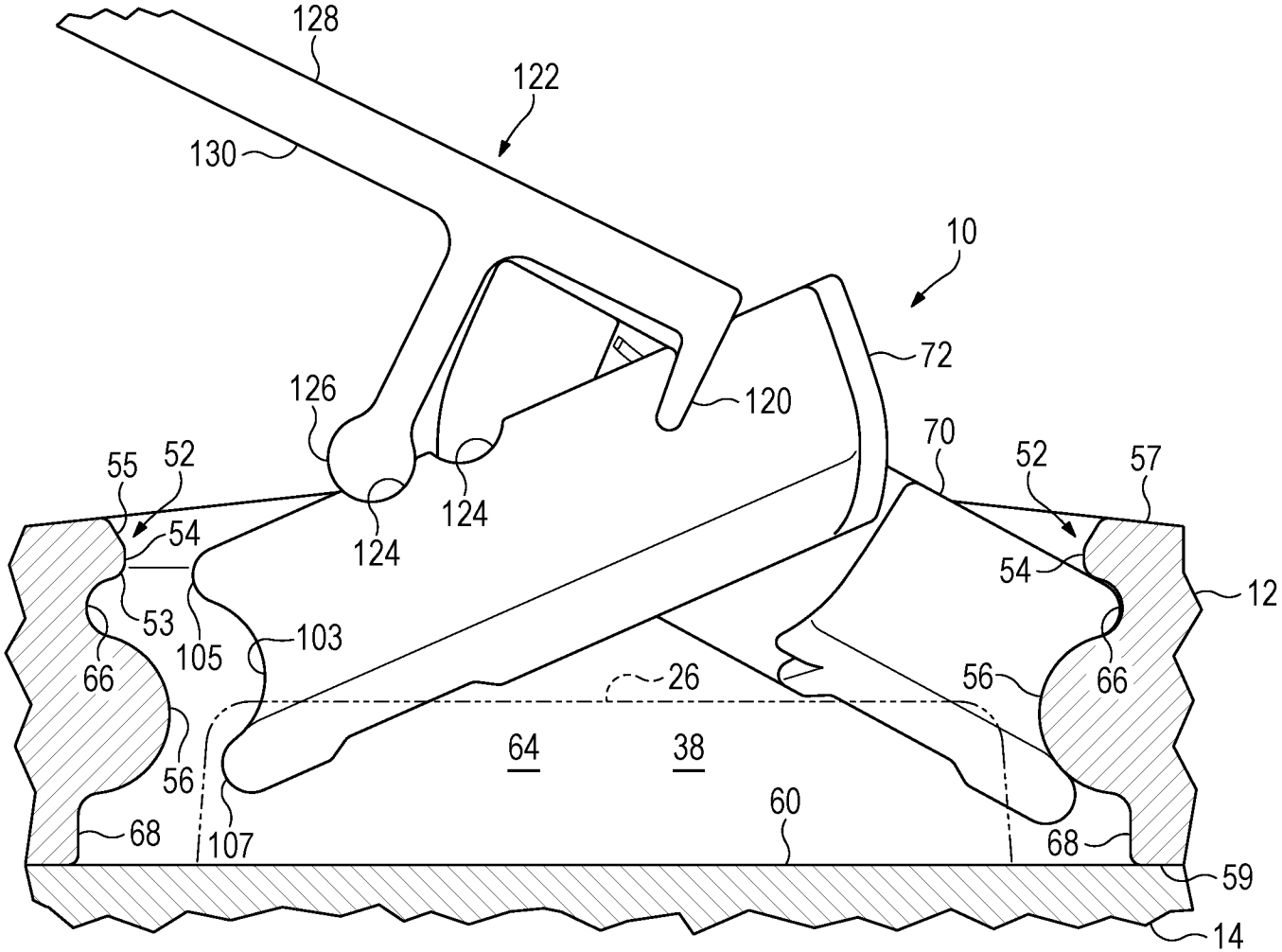
FIG. 14A is a cross-sectional view taken along line located at 14-14 in FIG. 13 showing the lock in the unlocked configuration being positioned into the hold position.
Figure 14B:
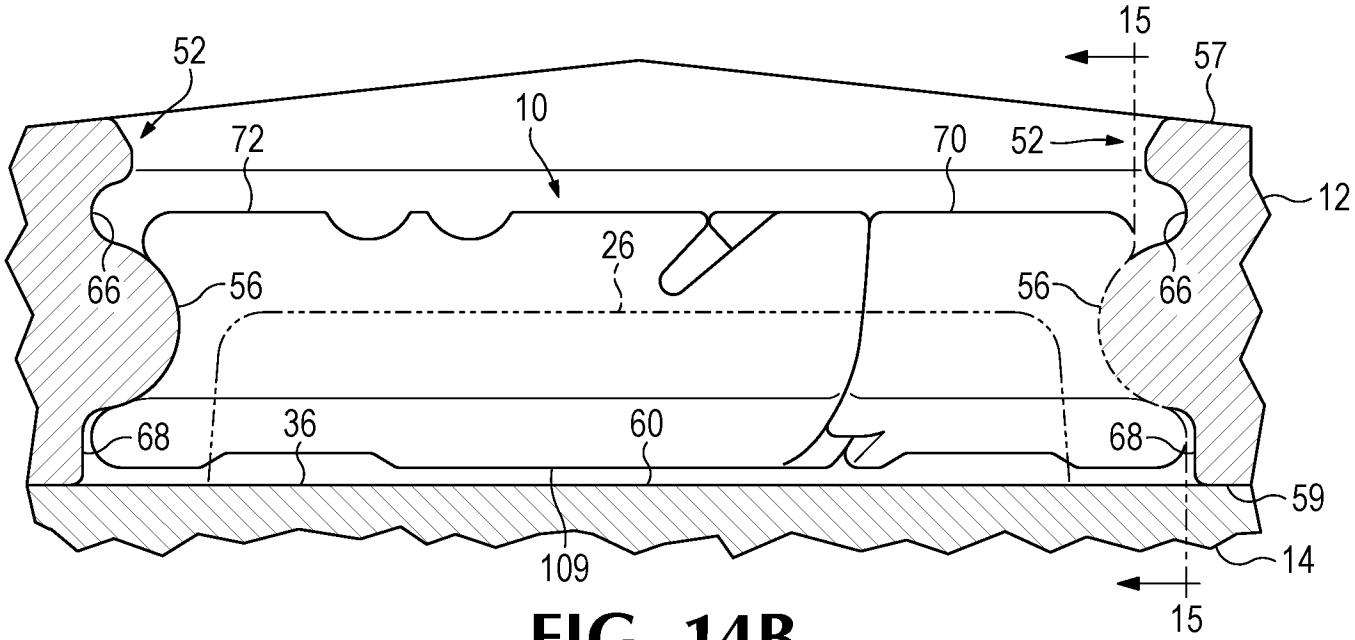
FIG. 14B is a cross-sectional view taken along line located at 14-14 in FIG. 13 showing the lock in the locked configuration and in the hold position.

The first or outer retainer 54 is, in this embodiment, in an outward position, i.e., proximate outer surface 57 of wear member 12 (FIGS. 11, 12). The second or inner retainer 56 is, in this embodiment, in an inward position, i.e., proximate inner surface 36 of wear member 12 (FIGS. 13, 14B). In this embodiment, lock 10 is received in gap 66 such that both retainers 54, 56 function to secure lock 10 in the release position. In the illustrated example, the second retainer 56 has a substantially semi-cylindrical surface. The first retainer 54 includes a curvilinear portion 53 and a substantially straight portion 55 (FIG. 14A) to reduce its upward extension and the thickness of top leg 20. Second retainer 56 preferably has a fuller contact with the lock to resist the anticipated heavier loads applied during use such as during a digging operation. The retainers, though, could have the same shape (e.g., both could be formed as a semi-cylindrical protrusion as shown for retainer 56), or either could have different shapes than shown. The first retainer 54 may be continuous or discontinuous as illustrated (FIGS. 4-5), i.e., with a central gap 58 to provide access to enable fines to be more readily cleaned from opening 39. Although not illustrated here, the second retainer 56 may also, or instead, be discontinuous.

The first retainer 54, in this example, protrudes into hole 38 a shorter distance than the second protrusion 56, although this is not necessary. A first or medial pocket or gap 66 is located between the retainers 54, 56. A second or inward pocket or gap 68 is located inward of retainer 56 (i.e., between retainer 56 and inner surface 36). The pockets 66, 68 may include straight, curvilinear or other surfaces (FIGS. 12, 14A, 14B). As illustrated, the second protrusion 56 may be made to include a substantially semi-cylindrical profile to provide a robust contact surface to contact the lock 10 in both an outward and an inward direction.

The lock 10 can be fitted within opening 39 to hold wear member 12 to the earth-working equipment 14. In general, with wear member 12 on lip 16, lock 10 is secured to second retainers 56 to oppose bearing face 40 of boss 26 and bearing surface 48 in hole 38 to hold the wear member 12 in place; i.e., with lock 10 in the hold position in opening 39, the wear member cannot be pulled from the lip 16 (FIG. 3).

In the illustrated embodiment, the lock 10 can be held at two different places on the wear member 12. The two places may be defined as a release position (e.g., where the lock is placed for shipping, storage and/or installation) (FIG. 12), and a hold position (e.g., where the lock can secure the wear member to the base) (FIG. 14B). The release position is where the bottom lobe 107 of the lock 10 is positioned between the inner retainer 56 and the outer retainer 54. The release position may also be defined as the inner lobes 107 are fitted into complementarily sized and shaped pockets 66. The pockets 66 may tend to "grip" the inner lobe 107. Other constructions are possible.

The lock may also have two different configurations: an unlocked or folded configuration where the lock can be installed or removed from the hole 38 and retainers 54, 56, and a locked or unfolded configuration where the lock can engage the retainers 54, 56 in hole 38. The lock may be installed in the release position of the hole at the time of manufacture, i.e., wherein one lock is securely mated with one wear member for shipping, storage and/or installation. When at a jobsite, while still in the locked configuration in the release position, the shroud can be installed on the base 25, i.e. installed onto the earth-working machine without modifying the lock in any way. The lock may then be adjusted to the unlocked condition and disengaged from the release position, and installed in the locked configuration engaging retainers 56 in the hold position on the wear member. In one example, the lock may be secured in the locked configuration with a single substantially rigid insert 100. The insert 100 may be a metal insert 100 made of, for example, steel. The lock may, then, be held in place without the need for an additional element, such as a latch, or an elastomer. Other lock constructions are possible.

Figure 8:
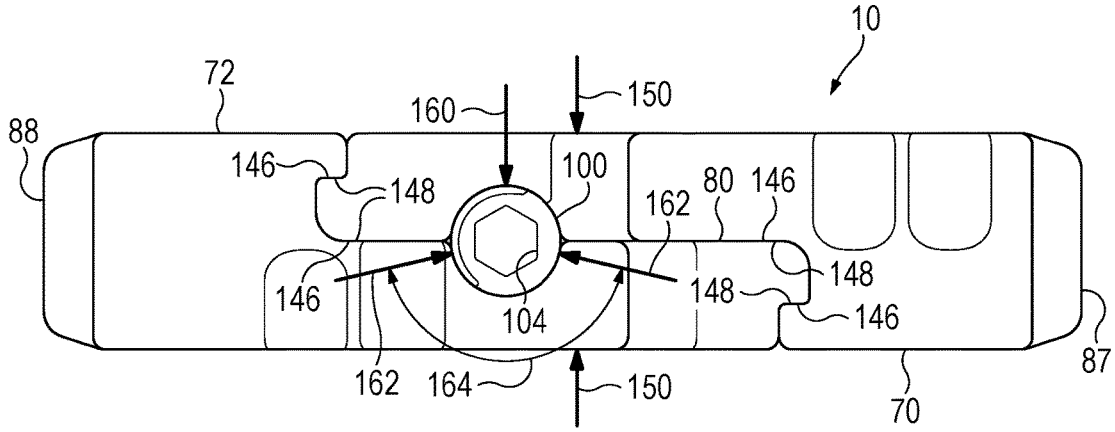
FIG. 8 is a top view of the lock in the locked configuration with the insert.
Figure 9:
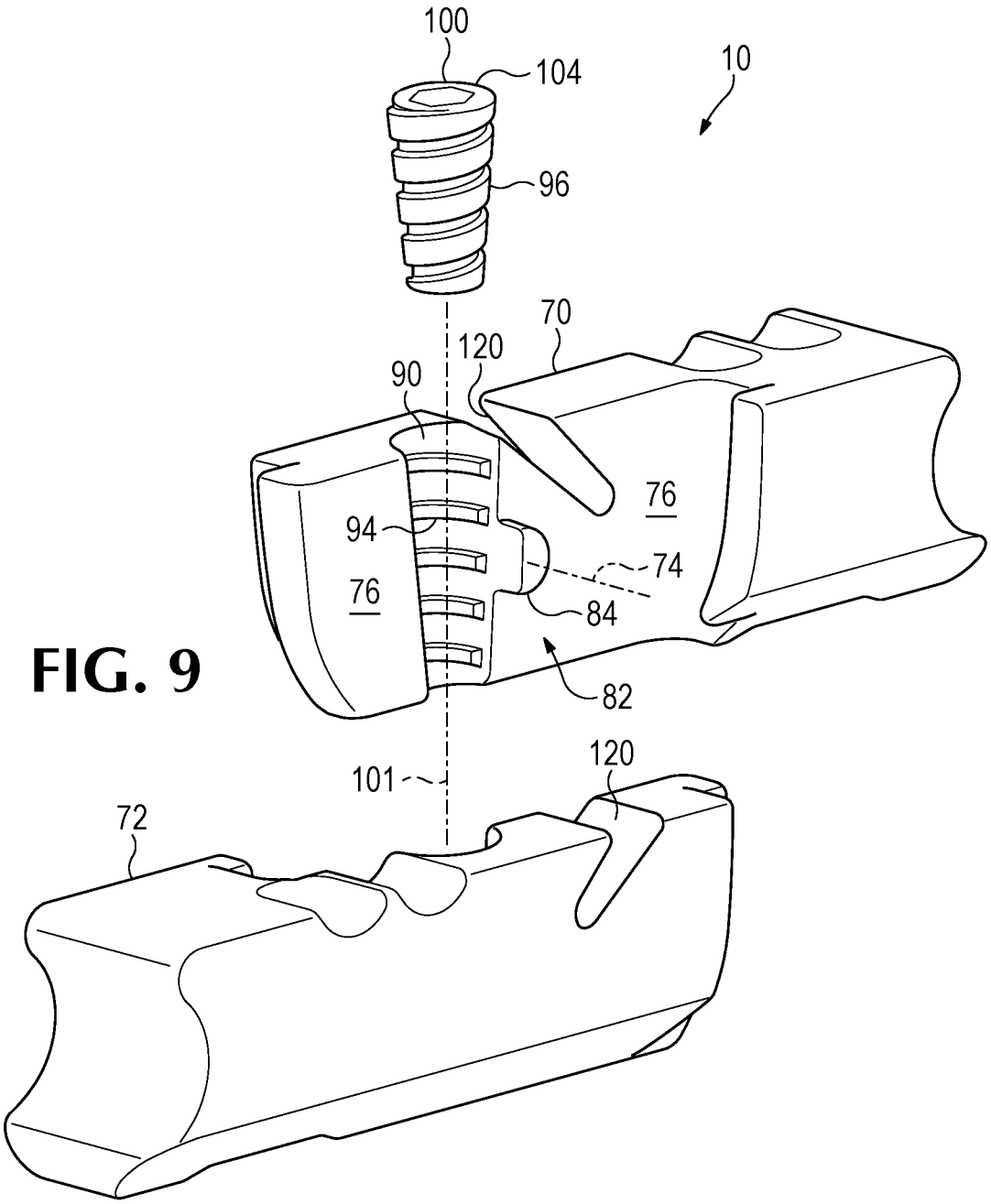
FIG. 9 is an exploded perspective view of the lock.
Figure 10:
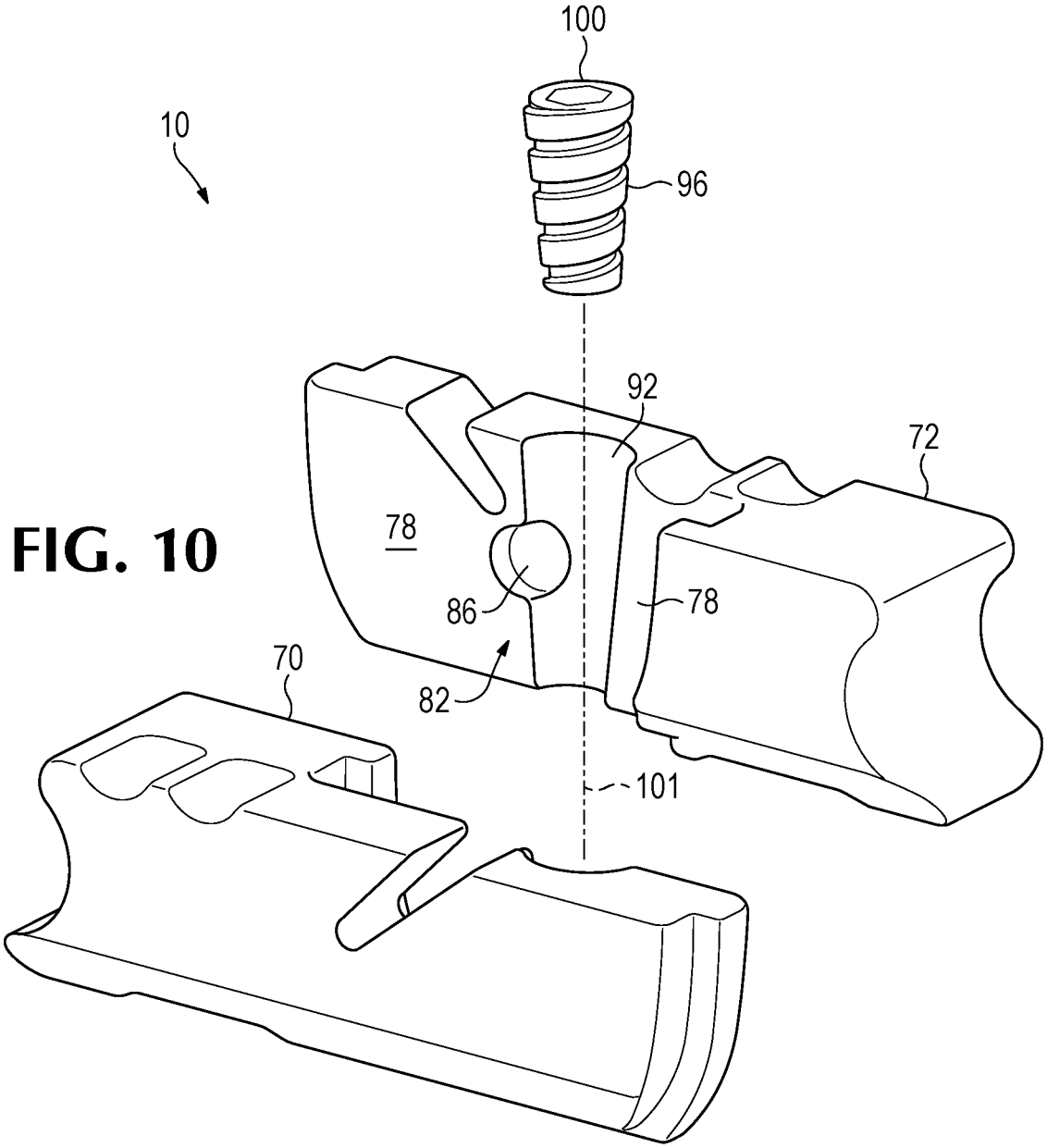
FIG. 10 is a reverse angle exploded perspective view of the lock shown in FIG. 9.

In the illustrated embodiment, lock 10 includes two bodies or components 70, 72 (FIG. 6-10) that are pivotally coupled together for movement about a lateral axis 74 between a locked condition (FIG. 14B) and an unlocked condition (FIG. 14A). The two bodies or components 70, 72 may be positioned to contact each other at respective first and second inner, or contact, faces 76, 78 (FIGS. 9-10). The junction of the contact faces 76, 78 may define a split line 80 (FIGS. 7, 8) wherein the lock 10 is separable into the two lock bodies 70, 72. While faces 76, 78 preferably contact each other (in this and the other disclosed embodiments), they could be spaced apart, i.e., where contact between the two bodies is elsewhere, e.g., in the interlocks.

Relative pivoting or hinging of the two bodies 70, 72 may be accomplished with a hinge mechanism 82. In the illustrated example, the hinge mechanism 82 includes an integral post 84 projecting from the first contact face 76 of the first body 70. The second contact face 78 includes a complementary hole 86 sized and located to receive the post 84 thereby pivotally coupling the first and second bodies 70, 72 together in an assembly 99 for limited movement about axis 74 (FIGS. 6-10). In this embodiment, the pivot axis 74 is generally parallel to longitudinal axis 44 of wear member 12 and perpendicular to the contact faces 76, 78. The pivot connection could have other constructions. For example, the hinge mechanism 82 could have other constructions including, for example, forming each body with a hole for receiving a pivot pin secured in place by retaining rings or the like.

Each body or component 70, 72 may define a channel 90, 92 (FIGS. 9-10) in faces 76 and 78. One channel 90 may include helical ridge segments 94 for engaging a groove or grooves 96 in an insert 100. When bodies 70, 72 are assembled together in the locked position, channels 90, 92 are aligned with each other to collectively form a tapered, partially threaded passage 102 adapted to matingly receive the insert 100 (FIGS. 6-10). Other shapes of passages and inserts are possible. Other ways of securing the insert in the passage besides threaded engagement are also possible.

In the illustrated embodiment, each channel 90, 92 defines, in lateral cross-section, a semi-circle so that the two channels collectively form a complete circular passage, though less than a full semi-circle for each or one channel is possible. In one embodiment, only one channel 90 is formed with thread segments 94 though both could be threaded. The channel(s) could also be partially threaded or threaded in a discontinuous way. Each channel 90, 92 progressively narrows so that collectively they form a generally frusta-conical bore or passage 102. Nevertheless, the passage and insert could be cylindrical.

The insert 100, in the form of a threaded frusta-conical rod, may be threaded into passage 102 with lock 10 in the locked position to prevent relative movement between the two components 70, 72. A hex socket 104 or other tool engaging formation is provided at the top of insert 100 for turning the insert 100. With the insert 100 installed in passage 102, bodies 70, 72 cannot be pivoted about axis 74. As a result, the lock presents a strong, integral pin to resist heavy loading and prevent release of wear member 12 from lip 16. The fitting of insert 100 into complementary channels 90, 92 that are formed in contact faces 76, 78 extending perpendicular to pivot axis 74 provides strong resistance to pivoting of the bodies and a low risk the insert will be ejected or broken. When insert 100 is removed, bodies 70, 72 can pivot about axis 74 from the locked configuration to the unlocked configuration (FIG. 14A). Insert 100 can have many different forms and be received in other openings provided in one or both components. For example, it could be unthreaded and secured by other means, it could have other shapes, and/or be inserted in other positions and/or at other locations. Insert 100 simply needs to secure lock components 70, 72 in its locked configuration.

As the insert 100 moves down passage 102, the insert 100 contacts a progressively smaller inner circumference in both channels 90, 92. In one embodiment, the radii of the insert 100 and channels 90, 92 in a fully seated position are generally the same. In another embodiment, the radius of curvature for one channel is smaller than the radius of the insert in corresponding positions when fully seated, while the curvature of the other channel generally matches or is larger than the insert. In one embodiment, the channel with the smaller radius is unthreaded. The threaded channel, then, maintains a single line contact while the non-threaded channel maintains a double line of contact. In this way, three lines of contact may provide substantially balanced forces 160, 162 each directed substantially toward a central axis 101 of the insert 100 having a single line of contact on one side of the central plane and a double line of contact on the opposite side. As alternatives, the smaller channel could be the threaded channel, or both or neither channel could be threaded. In a non-threaded passage, the insert would be secured by other means such as a retaining ring or latch.

Figure 7:
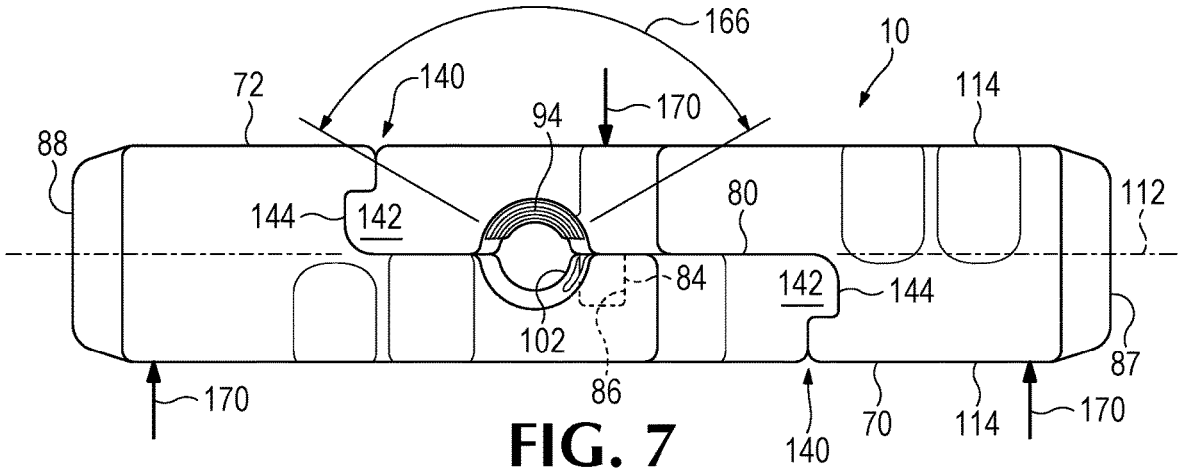
FIG. 7 is a top view of the lock in the locked configuration without the insert.

Embodiments may also provide threads in passage 102 that extend less than the total channel circumference, i.e. less than half the way around the bore. For example, the threads may only extend from as little as a few degrees to 175 degrees of circumference or more. Arrow 166, in FIG. 7, illustrates one example circumferential range of the treads 94. In some cases the threads may include a chamfer, or a fillet at each end of the thread profile nearest the slip planes which may reduce the circumferential extent of the threads. The double line loading may be delayed, or avoided, and the insert 100 may be threaded deeper into the bore. In this way, the insert 100 may be turned a considerable amount during a tightening operation. This may tend to provide a more comfortable confident feeling for the operator when tightening the insert 100.

Also, while bodies 70, 72 are disclosed as having the same or similar lengths and forming opposite ends of the lock 10, other arrangements could be used. For example, the bodies could have different lengths or each extend the full length of the lock. Also, the lock could comprise a foldable element, but not consist of two components joined by a pivot pin. Other arrangements could be used to present a firm, secure lock in the retaining position, but which permits folding of the lock to the release position. For example, lock 10 could have multiple hinges formed by three or more components. As another example, lock 10 could be foldable by a resilient hinge portion. Moreover, lock 10 could be formed without a hinge or a foldable portion; lock 10 could, rather, have different means for being releasably secured to retainers 54, 56. In one example, the lock could have an end that telescopes inward and outward to engage or release retainers 54, 56.

Lock 10 includes end walls 87, 88 that engage end walls 52 in the hole 38 in the wear part. For example, end walls 87, 88 may engage retainers 54, 56 when the lock is in the release position, which permits the wear member 9 to be installed and removed without removing the lock 10 from the wear member 9. The lock may be removed entirely from the wear member when the wear member is to be installed on and for removal from the wear working equipment, though preferably the lock is installed during manufacture of the assembly for shipping, storage and installation as an integral unit. Preferably, the lock is installed into wear member 12 at the time of manufacture and shipped, stored and installed with the lock in this release position engaged to retainers 54. End walls 87, 88 may engage retainers 56 when the lock is installed in the hold position to secure the wear member to the earth-working equipment 14. Lock 10 is in the locked configuration when secured to the retainers 54, 56, and in the unlocked configuration when being installed in or removed from the retainers 54, 56. As an alternative, retainers 54 could be omitted such that the lock is inserted after the wear member is installed on base 25. In this example, lock 10 could be shipped and stored with the lock engaging retainers 56, or shipped and stored separately from the wear member.

In the illustrated embodiment, end walls 87, 88 have a generally concave, curved configuration to complement the curved surfaces on retainers 54, 56, though other shapes on the end walls, and/or retainers could be used. In this example, the concave curved surface 103 defines a pair of spaced apart lobes 105, 107. The inner or bottom lobe 107 fits in to the medial pocket 66 when end walls 87, 88 engage release-position retainers 54. Inner lobe 107 fits in inner pocket 68 when end walls 87, 88 engage retainers 56. The outer lobe 105 can fit into pocket 66 or be short of the pocket 66. This kind of engagement or "gripping" of the retainers by the lock improves resistance against loss or ejection of the lock when insert 100 is in passage 102. This arrangement further enhances resistance to turning of the lock under load. Nevertheless, other kinds of end walls could be used. As examples only, end walls of the lock could be stepped, include projections, or be otherwise shaped to secure the lock in place.

In use, when in the hold position, the outer sides of second retainers 56 contact the inner sides of the outer lobes 105, and the inner sides of the retainers 56 contact the outer sides of the inner lobes 107. In this way resistant or corrective forces can be exerted on the lock in both an upward and a downward direction. The forces can be exerted along any location along the lobes, i.e. at any spaced distance from a central axis 112 of the lock to the side surfaces 114 of the lock 10. In this way, forces can be resisted by the ends of the lock engaging either set of retainers 54, 56 that would otherwise cause the lock to be subjected to, for example, any, drop, ejection, roll, or longitudinal twist.

Figure 15:
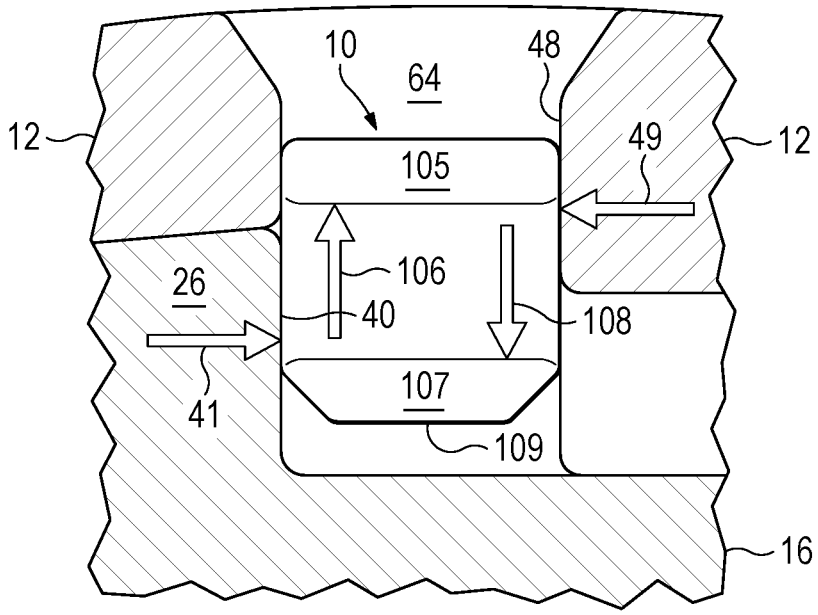
FIG. 15 is an offset cross sectional view taken along line 15-15 in FIG. 14B showing an example force profile that may be experienced by the lock and reaction forces.

For example, during use, forces will be applied to the lock 10 on one side by the bearing surface 48 of the wear member 12, shown with arrow 49, and on the opposite side by the bearing surface 40 boss 26, shown with arrow 41 (FIG. 15). Because the surfaces tend to be offset from one another the opposite forces tend to urge the lock to "roll" within the opening 39. However, according to the illustrated embodiment, the outer lobes 105 of the lock contact the outer surfaces of the second protrusions 56 of the wear member 12, arrow 106, and the inner lobes 107 of the lock contact the inner surfaces of the second protrusions 56, arrow 108. In this way, the lock 10 is kept from rolling within the opening 39.

In the illustrated embodiment, the lock does not have a uniform length. The length along lobes 105 is shorter than the length along lobes 107 to accommodate pivoting of the lock from the extended locked configuration to the retracted unlocked configuration (FIG. 16A), i.e., for sufficient clearance for lobes 105 to move farther into pocket 66 when lock 10 is pivoted to the unlocked configuration. Alternatives are possible. For example, medial pocket 66 could have a depth sufficient to accommodate pivoting when the lobes 105, 107 have the same length (i.e., when the inner and outer lengths of lock 10 are the same).

To replace a worn wear member, lock 10 must first be removed. To do so, insert 100 is removed from passage 102, and bodies 70, 72 pivoted about axis 74 to the unlocked configuration (FIG. 14A). In this position, the outer lobes 105 can move into the medial pocket 66 as illustrated. The shorter length of the lock 10 at the level of the outer lobes 105 enables the top lobe 105 to fit into the medial pocket 66 when lock 10 is pivoted to the un-retained or unlatched condition. The contour of the concave surface 103 of the lock end walls 87, 88 is able to follow the contour of the retainer 56 to yield a smooth pivoting of each respective lock body 70, 72.

In the hold position, the inner surface 109 of the lock 10 may, or may not, contact the bottom of the cavity 64. A small clearance may be allowed, or provided.

Figure 6:
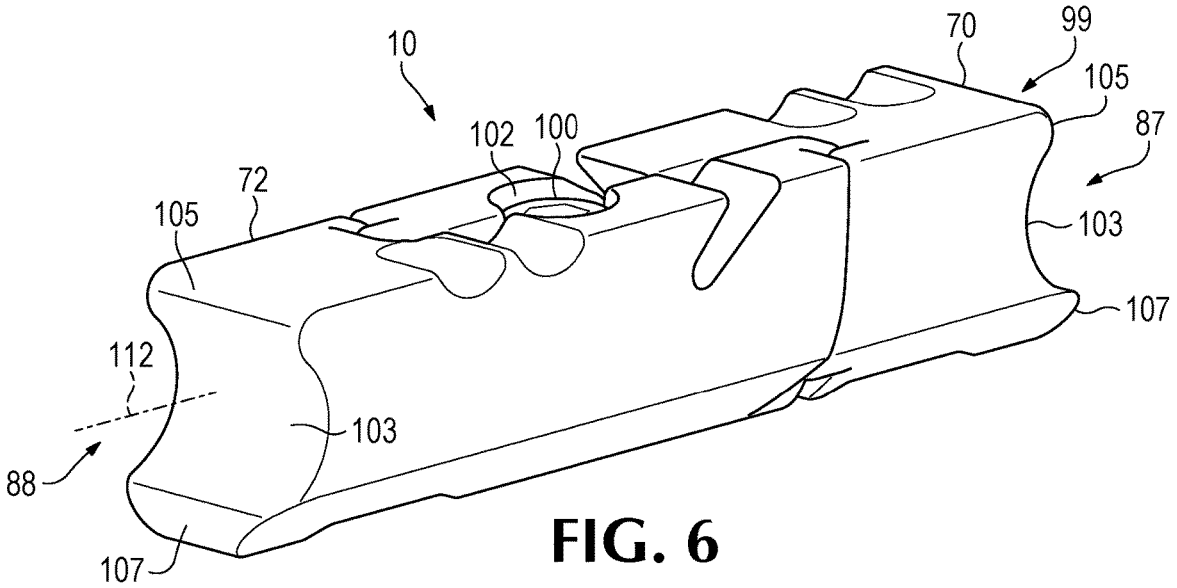
FIG. 6 is a perspective view of the lock in a locked configuration.

The lock 10 may include transverse interlocks 140 on each of the two lock bodies 70, 72 (FIG. 6). When the lock bodies 70, 72 are in the extended locked position, the interlocks 140 can keep the lock bodies 70, 72 from separating in a transverse direction. With the lock bodies 70, 72 fixed at the ends each body 70, 72 may bow slightly under stress caused when the insert 100 is forced into the passage 102 in a middle portion of the lock. The interlocks 140 may each include complementary tab 142 and retention slot 144 pairs, i.e. each body 70, 72 having a tab 142 at one end and a retention slot 144 at the opposite end, though other interlock constructions are possible (FIG. 7). The tab 142 may be slideable into the slot 144 in the same hinging motion about the pivot axis 74 as the hinging and unhinging, or straightening, motion of the lock bodies 70, 72 described herein. Each tab 142 may extend substantially radially from the pivot axis 74, and the inner opposed walls 146 of each retention slot 144 (when in the closed extended position) may extend in close coplanar proximity to outside opposite surfaces of the tab 142. The tab 142 surfaces and the retention walls may be angled slightly from parallel to provide a radial draft to provide rapid and unobstructed separation of the adjacent surfaces when the lock bodies 70, 72 are pivoted open. Tab ends and/or end walls of the slots 144 may also define a radial draft to also, or instead, provide rapid and unobstructed separation of the adjacent surfaces when the lock bodies 70, 72 are pivoted open. Each lock body 70, 72 can be transversely flexed away from a longitudinal axis 112 of the lock 10 by the insert 100, imparting a pre-load into the lock 10. The pre-loaded lock bodies 70, 72, in turn provide transverse retention forces 150 from opposite sides of the slip plane 80 to resist ejection of the insert 100. The resultant force components are generally perpendicular to the slip plane 80 and transverse to the longitudinal axis (FIGS. 6-8).

In the embodiments illustrated, various surfaces, for example, the interlocks 140 and the pivot pin 84 increase the stability of the assembled lock components 70, 72 even without the insert 100 in place. The interlocks 140 and the pivot pin 84 provide constraining surfaces that limit the degrees of freedom of relative movement between the lock components 70, 72, except for the relative pivoting, or hinging, movement. As discussed, the interlocks 140 resist relative lateral movement of the lock components. The pivot pin 84 extends across the contact faces 76, 78 in a lateral direction, and is accordingly disposed to resist relative longitudinal movement between the lock components 70, 72. Accordingly, even without the insert 100 in place the lock 10 is easy to handle, move, and otherwise manipulate. This may be particularly useful to the operator. The insert 100 may be disposed to prevent a relative pivoting or hinging between the lock components 70, 72. Consequently, the forces on the insert are relatively limited to resisting relative pivoting tending to protect the insert from deformation, and/or ejection.

The interlocks 140 and the pivot pin 84 tend to hold the lock in place, and resist various loads that may be placed on it. For example, a bending force 170 (FIG. 7) may impart tensile stress on one side of the central axis 112 and compressive forces on the other side. The bending forces will tend to pull the tab 142 on the side in tension out of the mating slot 144. However, the outer surface of the pivot pin 84 in contact with inside walls of the complementary hole 86 will resist relative longitudinal movement of the lock components 70, 72, adding to the strength and stability of the lock. In addition, the pivot axis 74 is preferably substantially perpendicular to, and proximate with, the central axis 101 of the insert 100. Accordingly, any relative pivoting or hinging of the lock components 70, 72 about axis 74 results in minimal displacement of passage 102 parallel to central axis 101 of the insert 100. Consequently, axial forces on the insert 100 directed to resist hinging is minimized reducing the potential for ejection or deformation.

Figure 16:
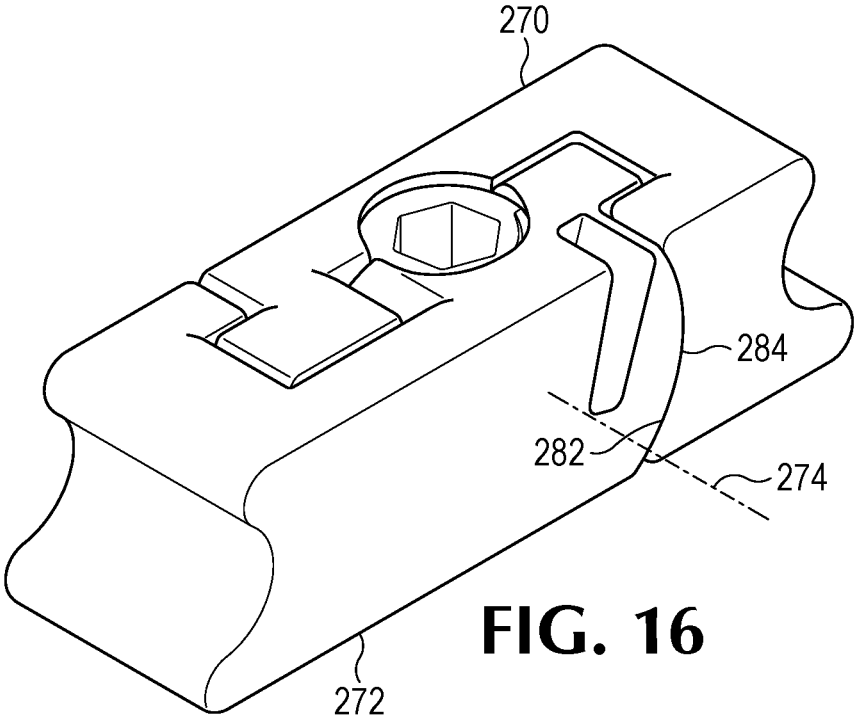
FIG. 16 is a perspective view of an alternative lock in the locked configuration.
Figure 17:
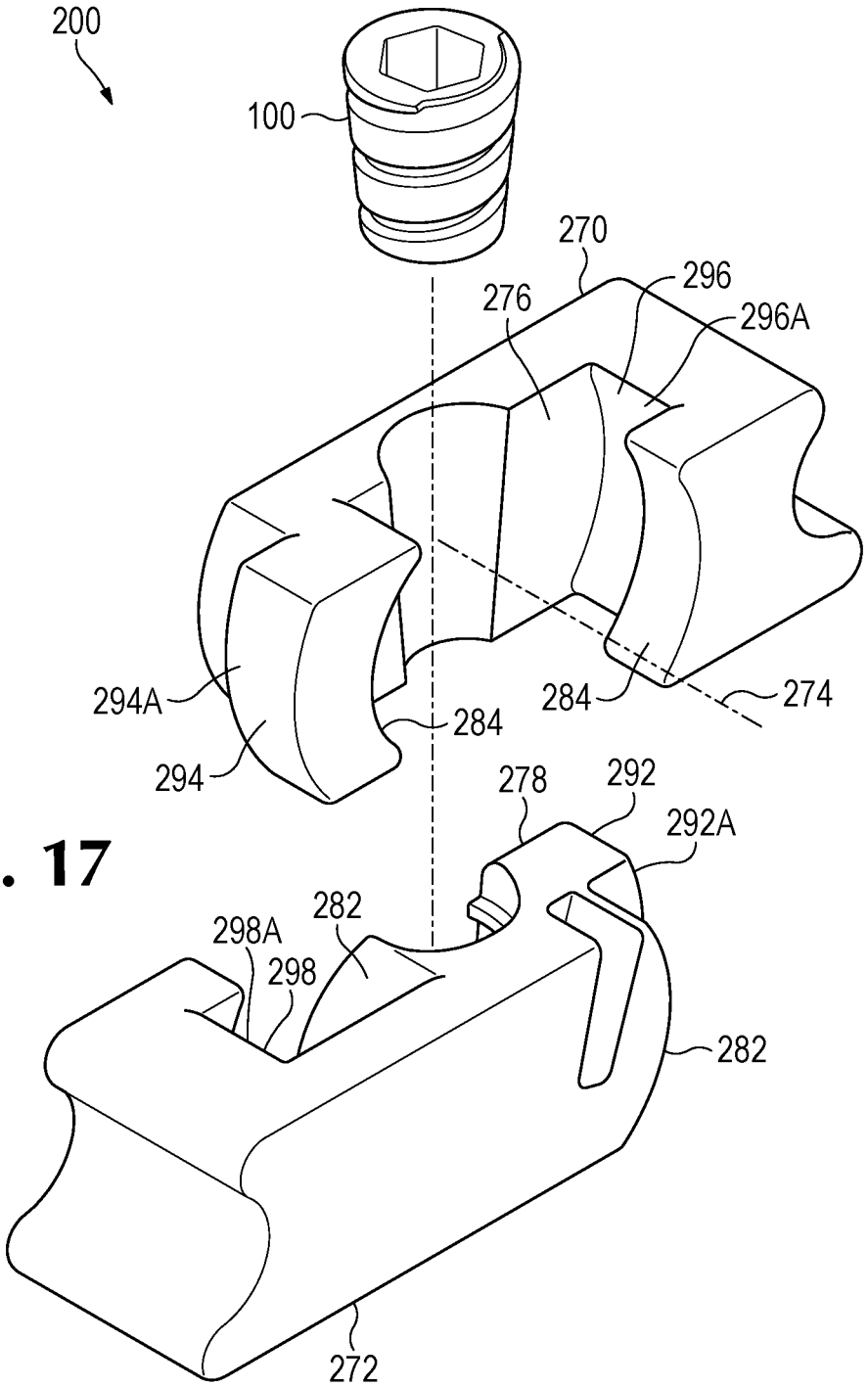
FIG. 17 is an exploded perspective view of the alternative lock shown in FIG. 16.

In one alternative embodiment, the interlock includes concentric walls 282, 284 able to slide relative one another to permit a relative pivoting motion of the lock bodies 270, 272 about pivot axis 274 (FIGS. 16-17). Each body can include a tab or protrusion and a slot that interlock in a tongue and groove configuration. Lock assembly 200 includes tabs 292 and 294 defining walls 292A and 294A. Spaced from the tabs, the lock assembly can include slots 296 and 298 defining walls 296A and 298A. These walls 292, 294, 296, 298 of the tabs and slots have generally corresponding shapes and are shown in FIG. 17 as being curved and concentric about the pivot axis. The walls can be any shape that allows the lock bodies to pivot about the pivot axis to fold and extend to full length without binding. Assembly of the hinge can include bringing contact face 276 to contact face 278 with the longitudinal axes of the bodies 270, 272 generally at an angle to each other (i.e. without engagement of tabs 292, 294 in slots 296, 298). With rotation of the bodies 270, 272 in relation to each other about the pivot axis 274, each of the tabs pass into the corresponding slots. The interlocking bodies once assembled to each other resist separation. Rotation of the bodies in relation to each other can be limited by the installation of insert 100.

End walls 87, 88 of the lock clear end walls 52 of the opening 38 so that the lock can be withdrawn from the wear member 12. At least one body 70, 72 (and preferably both to enable removal from either direction) is provided with a grip 120 to facilitate pivoting of the bodies and pulling the lock from the opening. In one embodiment, grips 120 are formed as inclined cavities to receive a removal tool 122; although other forms of grips could be used. Each body 70, 72 can also include a depression 124 spaced from grip 120 to stably support a fulcrum 126 of tool 122. In use, a gripping end 128 of tool 122 fits into cavity, or grip 120 on body 70 (or 72) with fulcrum 126 resting in one depression 124. The lever 130 of tool 122 is pushed downward to pull the middle of lock 10 upward such that the bodies 70, 72 pivot about hinge mechanism 82. In this position, the lock 10 can be pulled out of opening 38 with tool 122 to permit removal of the shroud from the equipment.

Figure 18:
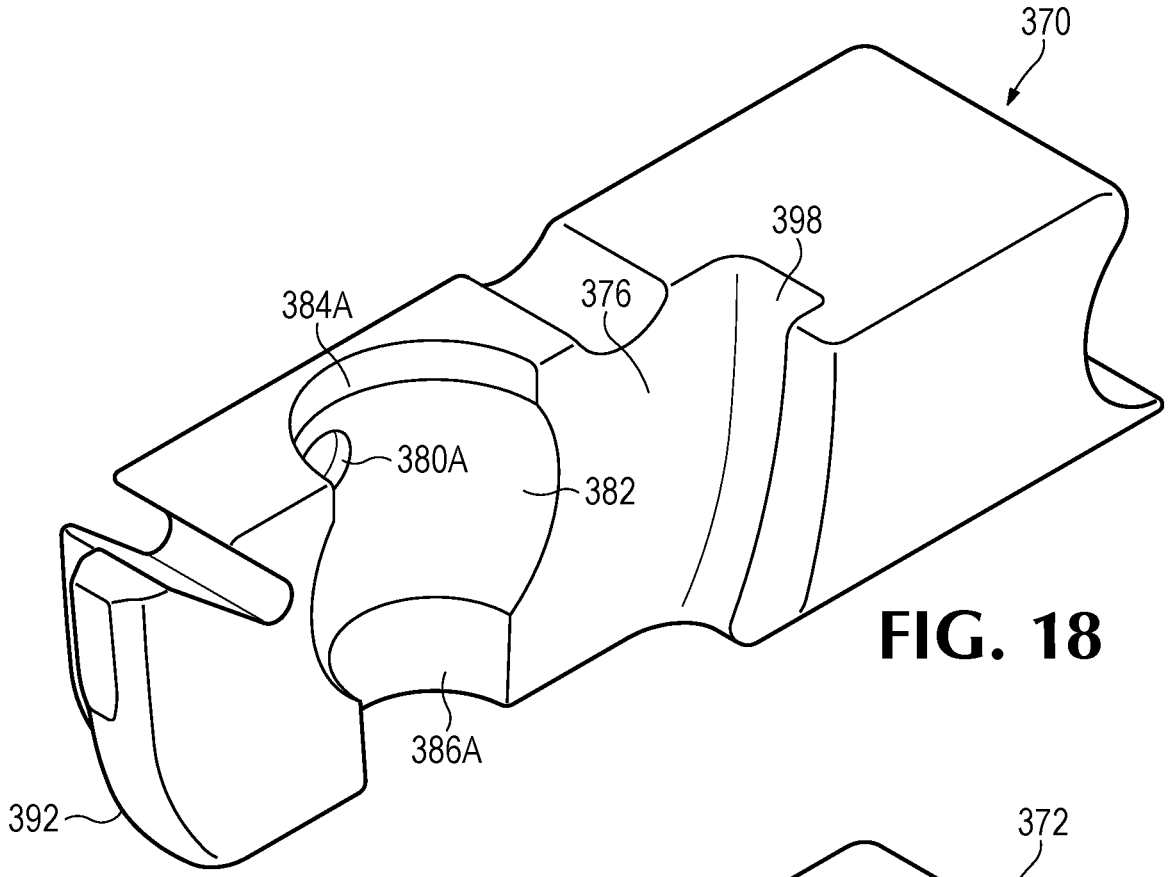
FIG. 18 is a perspective view of a first member of a second alternative lock.
Figure 19:
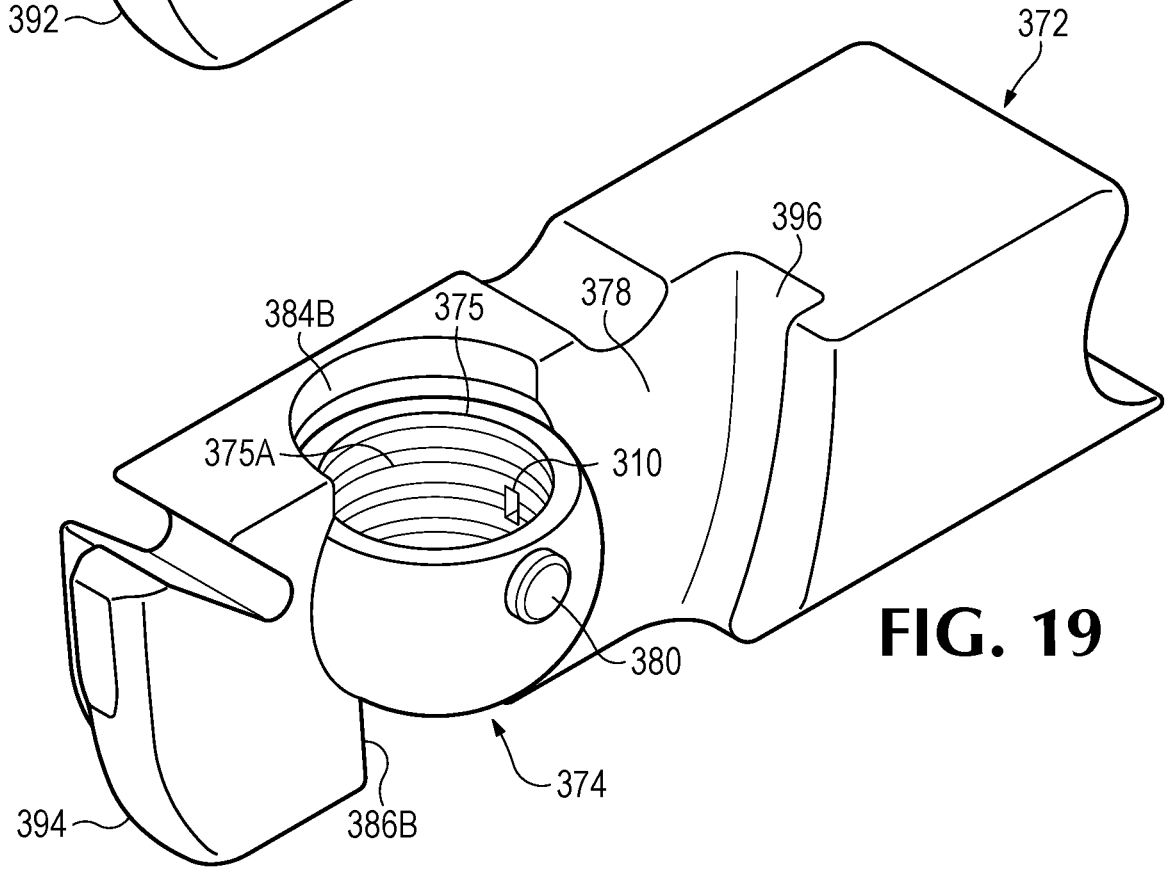
FIG. 19 is a perspective view of a second member of the second alternative lock to be assembled to the member of FIG. 18.

FIGS. 18 and 19 show an alternative construction of an articulated lock. First body 370 and second body 372 include tabs 392 and 394 and slots 396 and 398 respectively that will engage in a tongue and groove configuration on assembly of the bodies. First body 370 has a contact or inner face 376 and second body 372 has contact or inner face 378. Contact face 376 preferably has a generally hemispherical recess 382 and an opening 380A. Above and below the hemispherical recess are preferably curved bearing surfaces 384A and 386A. Contact face 378 includes a laterally-projecting threaded collar or protrusion 374 provided with a pin 380. The collar has an opening or passage 375 extending through it along a passage axis that is generally parallel to the contact faces and generally perpendicular to the pivot axis of the lock. The passage 375 is provided with threads 375A in the wall of the opening. Second body 372 includes a recess 382 to receive collar 374, and a hole 380A to receive pin 380. Above and below the collar are curved bearing surfaces 384B and 386B.

Figure 20:
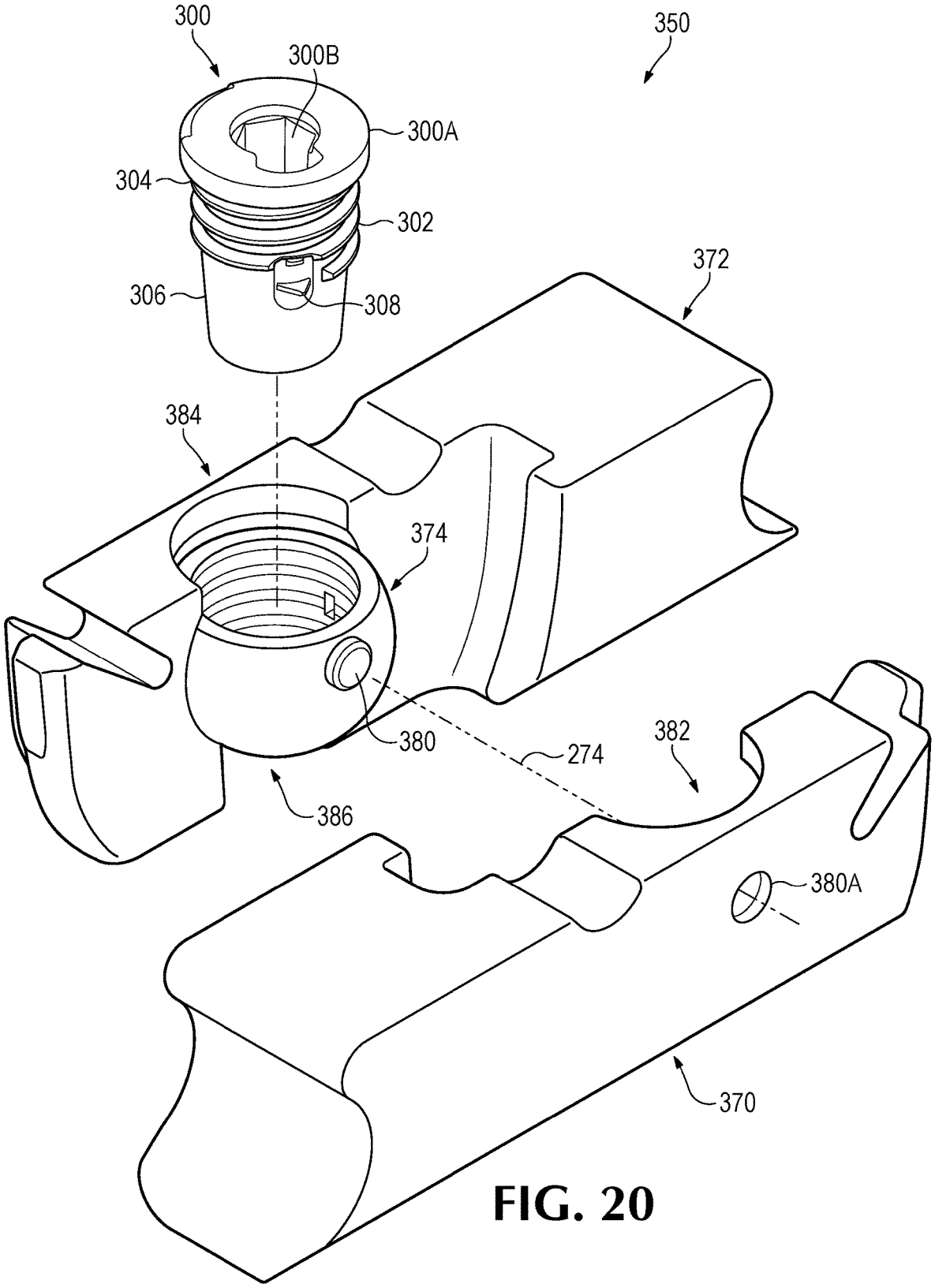
FIG. 20 is an exploded view of the second alternative lock.

FIG. 20 is an exploded view of the lock 350. The bodies 370 and 372 are assembled so that the collar 374 with the threaded passage 375 and pin 380 are received by recess 382 and hole 380A respectively. The collar and the recess have complementary shapes to allow the lock bodies to pivot relative to each other about the pin and hole defining a pivot axis 274 with limited binding. The exterior of collar 374 and recess 382 are preferably spherical segments, though other shapes are possible. Tabs 392 and 394 are received by slots 396 and 398 as the bodies pivot to an extended position. Other shapes can be used for the surfaces of the collar and recess, and the collar and recess are not necessarily mating shapes. Preferably, the collar is symmetrical about a pivot axis and allows pivotal movement of the bodies once assembled.

With the lock in the extended position, the bearing surfaces 384A and 384B adjacent each other form a single circular upper bearing surface 384. Similarly bearing surface 386A and 386B adjacent each other form lower circular bearing surface 386. The bearing surfaces, though, need not form a complete circle. With the bodies 370, 372 in the extended position, threaded insert 300 is received in threaded opening 375. Threaded insert 300 preferably includes a head 300A with a recess 300B to receive a torque tool (not shown) such has a hex driver, though other tool-receiving formations could be used. Although insert 300 is shown with a radially expanded head, the head can simply be the trailing end of the shaft, i.e., a continuation of the shaft with no radial extension. Also, while a threaded insert 300 and threaded opening 375 are preferred, they could each be non-threaded with other means (e.g., a latch) for retaining the insert in the opening.

Threaded insert 300 can optionally include a biased latching tooth 308 extending from the insert. The tooth can engage a corresponding outer pocket or recess 310 in the threaded opening 375 of the collar. The tooth engaging the recess can limit rotation of the insert below a set level of applied torque and prevent the insert from inadvertent loss of the insert from the lock. The interlocking tooth and recess can define a stop for the fully installed position.

A shaft of the insert 300 preferably includes an upper bearing surface 304, a lower bearing surface 306, and threads 302 between the two. When insert 300 is fully threaded in passage 375, the upper and lower bearing surfaces 304 and 306 are adjacent to or bearing on bearing surfaces 384 and 386 respectively. The fitting of the upper and lower bearing surfaces 304, 306 of the insert 300 with the bearing surfaces 384, 386 of the bodies 370, 372 limits pivoting movement of the bodies 370 and 372 about pivot axis 274. In use, the lock 350 is received in the opening of the wear member in a similar way to previous locks described above and engages the retaining structure of the opening in a similar way. The threaded opening can include complete threads that continue around the circumference of the opening. Alternatively, the opening can include thread portions or ridges in the opening to engage threads 302 of the insert 300.

Lock bodies 370, 372 and insert 300 are shown with upper and lower bearing surfaces but other constructions are possible. For example, the insert can have a head 300A, threads 302 and a lower bearing surface 306 without the upper bearing surface 304. The head can act as the upper bearing surfaces in some constructions. In another example, the lock has only threads and a lower bearing surface to bear on the insert 300 without an upper bearing surface. In another construction, the lock has threads and an upper bearing surface to bear on the insert without a lower bearing surface.

Figure 21:
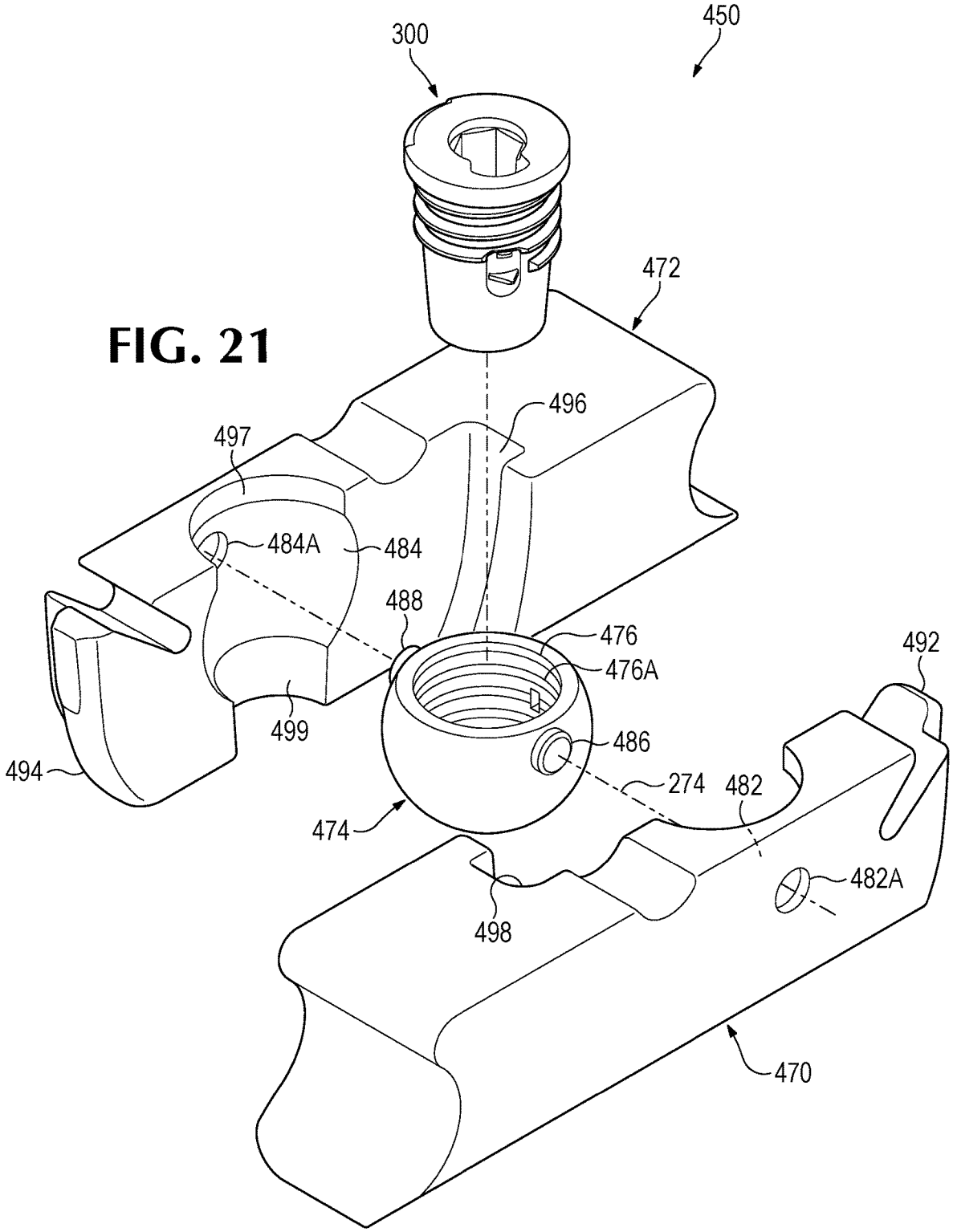
FIG. 21 is an exploded view of a third alternative lock.

FIG. 21 shows an alternative construction of a lock 450 that includes bodies 470 and 472 with similar features to locks described above. First body 470 and second body 472 include tabs 492 and 494 and slots 496 and 498 respectively that will engage in a tongue and groove configuration on assembly of the lock bodies. Here the bodies each preferably have a hemispherical recess 482 and 484 each with an opening 482A and 484A. A collar 474 separate from the bodies 470, 472 is received in recesses 482, 484. The collar 474 is provided with an opening or passage 476 that passes through the collar and is provided with threads 476A in the walls of the passage. The collar has pins 486 and 488 on opposite sides.

Lock 450 is assembled by receiving collar 474 in recesses 482 and 484 with pins 486 and 488 in openings 482A and 484A. Lock bodies 470 and 472 then pivot about the pins and openings to an extended position with tabs 492 and 494 received by slots 496 and 498. In the extended position, upper circular bearing surface 497 is above collar 474. Lower circular bearing surface 499 is below collar 474. Insert 300 is received in the threaded collar and bearing surfaces 302 and 304 bear on or are adjacent to bearing surfaces 497 and 499. When installed, the insert limits pivotal movement of bodies 470 and 472 in relation to each other. Other embodiments are possible with only an upper bearing surface or only a lower bearing surface to bear on insert 300.

Other shapes can be used for the surfaces of the collar and recess and the collar and recess are not necessarily mating shapes. Preferably, the collar is symmetrical about a pivot axis and allows pivotal movement of the bodies once assembled.

Figure 22:
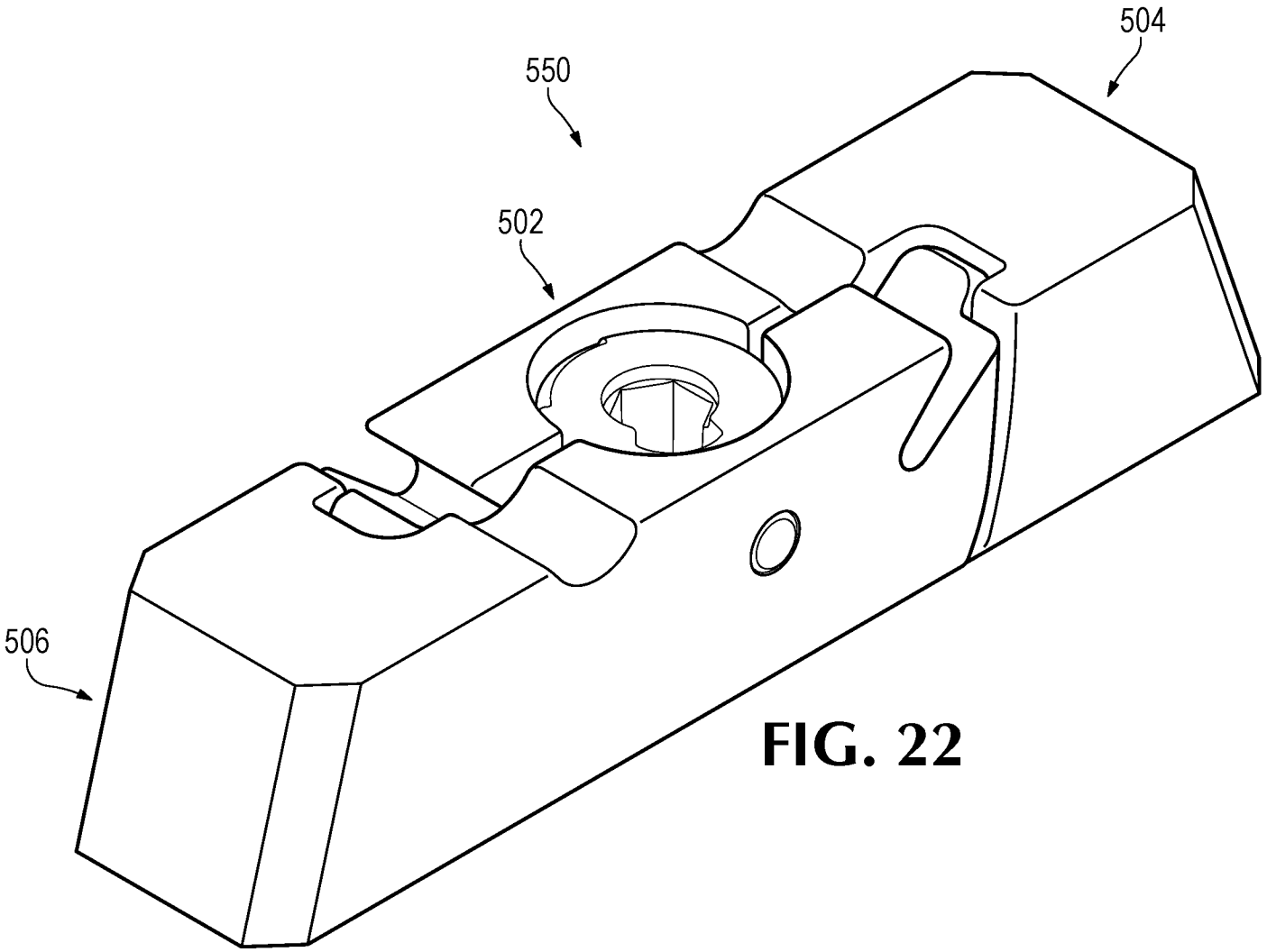
FIG. 22 is a perspective view of a lock with a fourth alternative lock.

The ends of the lock can have different constructions to engage a receiving structure of the wear member opening. FIG. 22 is a lock 550 with a middle structure 502 similar to locks described above, i.e., for example with a tongue and groove structure and an insert that limits pivotal movement. Lock 550 has beveled ends 502 and 504 that converge extending upwards. Lock 550 can be received in an opening of a wear member with a corresponding construction. Such wear members are described in U.S. Pat. No. 7,536,811 which is incorporated hereby by reference in its entirety. Any of the locks described herein could be formed with beveled ends (or other ends) to fit into different wear members and secure the wear members to the earth working equipment.

The above-discussed embodiments are preferred embodiments of the present invention. Various alternatives could be used. For example, the retainers may be threaded rods or threaded wedges in any of the disclosed embodiments. The retainers may have considerably different constructions and include shifting plates, detents, latches, etc. The pivot axis or hinge may be defined in other ways that permit the desired movement of the bodies. Folding of the locking component could also be achieved by other means. In general, various other embodiments as well as many changes and alterations may be made without departing from the spirit and broader aspects of the invention.

The invention claimed is:

1. A lock for securing a wear member to earth working equipment comprising hinged members pivotally coupled together for movement between an extended position and a retracted position, and an insert, wherein the hinged members are interlocked by tongue and groove configurations to limit separation of the members along a pivot axis of the hinged members, and pivoting movement of the hinged members is prevented by installation of the insert when in an extended position to secure the wear member to the earth working equipment, and wherein each hinged member has a tongue and a groove, and each said tongue is received in and bounded on opposite sides by the groove on the other hinged member.

2. The lock of claim 1 wherein the tongues and grooves each include curved end walls that slide relative to each other when the hinged members are pivoted to a retracted position.

3. The lock of claim 1 wherein the insert is frusta-conical and the hinged members meet along a split line that extends transverse to the pivot axis about which the lock members move, each of the lock member includes a frusta-conical bore portion defined along the split line to collectively define a frusta-conical bore when the lock members are in the extended position, and the frusta-conical insert is received in the frusta-conical bore to prevent pivotal movement of the two members relative to each other.

4. The lock of claim 3 wherein one bore portion is smaller than the received insert to generally define a three line engagement of the lock components with the insert.

5. The lock of claim 3 wherein the insert is threaded and at least one of the bore portions includes a formation to engage the threads of the insert.

6. The lock of claim 1 wherein the hinged members meet along a split line that extends transverse to the pivot axis about which the hinged members move, one of the hinged members includes a recess along the split line and the other of the hinged members includes a collar along the split line to be received in the recess, and the collar includes an opening to receive the insert.

7. The lock of claim 6 wherein the insert and the opening are each threaded for engagement with each other.

8. The lock of claim 6 wherein the recess includes a hole and the collar includes a pin received in the recess.

9. The lock of claim 1 including a collar with an opening, wherein the hinged members meet along a split line that extends transverse to the pivot axis about which the hinged members move, each said hinged member includes a recess that receives the collar and at least one bearing surface adjacent the recess, and the insert is received in the collar to engage the bearing surface on each said hinged member.

10. The lock of claim 9 wherein the recess includes a hole and the collar includes a pin received in the recess.

11. A lock for securing a wear member to earth working equipment comprising hinged members each with an inner face, the hinged members being pivotally coupled together for movement along the inner faces between an extended position and a retracted position, and an insert, wherein a first hinged member includes a recess in the inner face and a first bearing face adjacent the recess, a second hinged member includes a collar with a hole and a second bearing face adjacent the collar, the collar is received in the recess, and the insert is installed in the hole and engages the bearing surfaces to limit pivotal movement of the hinged members and secure the wear member to the earth working equipment.

12. The lock of claim 11 wherein the insert and the hole are threaded with the threads engaged when the insert is installed.

13. A lock for securing a wear member to earth working equipment comprising (i) hinged members each with an inner face, a recess in the inner face and a bearing surface adjacent the recess, the hinged members being pivotally coupled together for movement along the inner faces between an extended position and a retracted position, (ii) a collar received in the recesses and including a hole, and (iii) an insert, wherein the insert is installed in the hole and engages the bearing surfaces to limit pivotal movement of the hinged members and secure the wear member to the earth working equipment.

14. A lock for securing a wear member to earth working equipment comprising hinged members pivotally coupled together for movement about a pivot axis between an extended position and a retracted position, and an insert, wherein the hinged members are interlocked by at least one tongue and groove configuration to limit separation of the hinged members along the pivot axis, the at least one tongue is bounded on opposite sides when received in the groove when the hinged members are in the extended position, and pivoting movement of the hinged members is prevented by installation of the insert between the members when in a locked position to secure the wear member to the earth working equipment.

* * * * *